US008820866B2

(12) United States Patent
Kasahara

(10) Patent No.: US 8,820,866 B2
(45) Date of Patent: Sep. 2, 2014

(54) NAIL PRINT APPARATUS AND PRINTING CONTROL METHOD

(75) Inventor: Hirokiyo Kasahara, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 226 days.

(21) Appl. No.: 13/570,562

(22) Filed: Aug. 9, 2012

(65) Prior Publication Data

US 2013/0038648 A1 Feb. 14, 2013

(30) Foreign Application Priority Data

Aug. 12, 2011 (JP) ..... 2011-176503

(51) Int. Cl.

| | |
|---|---|
| ***B41J 3/00*** | (2006.01) |
| ***B41J 3/407*** | (2006.01) |
| ***B41J 11/00*** | (2006.01) |
| *A45D 29/00* | (2006.01) |

(52) U.S. Cl.

CPC ..... *B41J 3/407* (2013.01); *B41J 11/008* (2013.01); *A45D 2029/005* (2013.01)

USPC ..... 347/2; 347/106

(58) Field of Classification Search

CPC ..... A45D 2029/005

USPC ..... 347/2, 106

See application file for complete search history.

(56) References Cited

U.S. PATENT DOCUMENTS 6,286,517 B1 * 9/2001 Weber et al. ..... 132/73
6,336,694 B1 * 1/2002 Ishizaka ..... 347/2

FOREIGN PATENT DOCUMENTS

JP 2003-534083 A 11/2003

* cited by examiner

*Primary Examiner* — Manish S Shah
*Assistant Examiner* — Jeffrey C Morgan
(74) *Attorney, Agent, or Firm* — Holtz Holtz Goodman & Chick PC

(57) ABSTRACT

A nail print apparatus which prints on a nail and a print controlling method. According to one implementation, a nail print apparatus includes an imaging section, a finger dimension obtaining section, a storage section, a model selecting section, a region specifying section and a printing section. The model selecting section selects one specific nail region extracting model based on a dimension of the finger obtained by the finger dimension obtaining section. The region specifying section specifies a nail region to be a specific nail region extracting model selected by the model selecting section to a region of the nail in the finger image obtained by the imaging section. The printing section applies ink on the specified nail region.

17 Claims, 23 Drawing Sheets

FIG. 12

| NUMBER | X-COORDINATE | Y-COORDINATE |
|---|---|---|
| 1 | 11 | 12 |
| 2 | 11 | 11 |
| 3 | 12 | 10 |
| 4 | 12 | 9 |
| 5 | ⋮ | ⋮ |
| 6 | ⋮ | ⋮ |
| 7 | ⋮ | ⋮ |
| 8 | 13 | 6 |
| 9 | 14 | 5 |
| 10 | 15 | 5 |
| 11 | 16 | 6 |
| 12 | ⋮ | ⋮ |
| 13 | ⋮ | ⋮ |
| 14 | ⋮ | ⋮ |
| 15 | 18 | 9 |
| 16 | 18 | 10 |
| 17 | 19 | 11 |
| 18 | 19 | 12 |

NAIL PRINT APPARATUS AND PRINTING CONTROL METHOD

CROSS-REFERENCE TO RELATED APPLICATIONS

This application is based upon and claims the benefit of priority from the prior Japanese Patent Application No. 2011-176503, filed Aug. 12, 2011, the entire contents of all of which are incorporated herein by reference.

BACKGROUND OF THE INVENTION

1. Field of the Invention

The present invention relates to a nail print apparatus and a printing control method. Specifically, the present invention relates to a nail print apparatus and a printing control method which uses a nail region extracting model when specifying the nail region on which printing is performed.

2. Description of the Related Art

A nail print apparatus is a print apparatus where a finger of a nail to be printed is positioned on a finger placement stage provided on an apparatus main body and an image including color and patterns is printed using a printing head of an ink jet method on the nail of the positioned finger. With such nail print apparatus, the region of the nail of the finger (hereinafter referred to as "nail region") needs to be detected accurately in order to specify the printing position and the printing range.

Conventionally, there is provided a method to image a finger image and to process the obtained finger image to recognize the region corresponding to the nail in order to determine the boundary between the nail region and the portion other than the nail region (in other words, the outline of the nail) to recognize the nail region. Such nail print apparatus is described in, for example, Japanese Patent Application Laid-Open Publication No. 2003-534083.

If the nail region can be extracted automatically from the finger image, the burden of input by the user can be kept to a minimum and the nail region as the print target can be automatically detected to perform printing.

However, actually, the optical properties of the nail and the skin are very close, and include the same color information. Moreover, the color of the nail and the skin is different according to each individual. Therefore, it is not easy to accurately extract the nail region by simply processing the finger image.

Japanese Patent Application Laid-Open Publication No. 2003-534083 merely describes the finger image is analyzed by the impression of the finger, and does not describe a specific method to extract and to specify the nail region accurately. Therefore, it is difficult to extract and to specify the nail region accurately from only the technique disclosed in the document.

As a specific method to extract and to specify the nail region by analyzing the image, a model nail image can be fit in a finger image of the user and the position and the range of the nail can be specified.

However, unlike extracting parts of a face, etc. where a position of each part is roughly fixed, there is no standard for fitting a nail when the nail region is extracted and specified. Therefore, it is difficult to fit a model nail image in a suitable position of the user finger image.

Moreover, the size and position of the nail greatly differs according to sex (male or female), physique (fat, thin, etc.), age (adult or child), and the like, and the shape of the nail is also different depending on the person. Therefore, a model which matches the sex, physique, etc. of the user needs to be used when the nail region is extracted and specified using the nail image model. However, in such case, the user needs to input information such as sex, physique, etc. which complicates the operation of the nail print apparatus and is a burden to the user.

SUMMARY OF THE INVENTION

The present invention has an advantage of providing a nail print apparatus and a printing control method in which a nail region extracting model is automatically selected and the nail region of the user is specified using the selected nail region extracting model in order to print on the nail of the user rapidly and highly accurately.

In order to obtain the above advantages, according to an aspect of the present invention, there is provided a nail print apparatus which prints on a nail including:

an imaging section which obtains a finger image by imaging a finger including a nail to be printed;

a finger dimension obtaining section which obtains a dimension of the finger from the finger image obtained by the imaging section;

a storage section which stores a plurality of nail region extracting models including outlines with shapes different from each other;

a model selecting section which selects one specific nail region extracting model from the plurality of nail region extracting models stored in the storage section based on the dimension of the finger obtained by the finger dimension obtaining section;

a region specifying section which specifies a nail region which is to be a print target of the finger by fitting the specific nail region extracting model selected by the model selecting section to a region of the nail in the finger image; and a printing section which includes a printing head to apply ink to the nail region specified by the region specifying section.

In order to obtain the above advantages, according to another aspect of the present invention, there is provided a printing control method of a nail print apparatus which prints on a nail including the steps of:

obtaining a finger image by imaging a finger including a nail to be printed;

obtaining a dimension of the finger from the obtained finger image;

selecting one specific nail region extracting model from a plurality of nail region extracting models including outlines with shapes different from each other stored in a storage section based on the obtained dimension of the finger;

specifying a nail region which is to be a print target of the finger by fitting the selected specific nail region extracting model to a region of the nail in the finger image; and applying ink to the specified nail region with a printing head.

Additional advantages of the invention will be set forth in the description which follows, and in part will be obvious from the description, or may be learned by practice of the invention. The advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention;

FIG. 12 is a diagram showing an example of a sample file;

DETAILED DESCRIPTION OF THE INVENTION

The nail print apparatus and printing control method of the present embodiment is described in detail.

Figure 1:
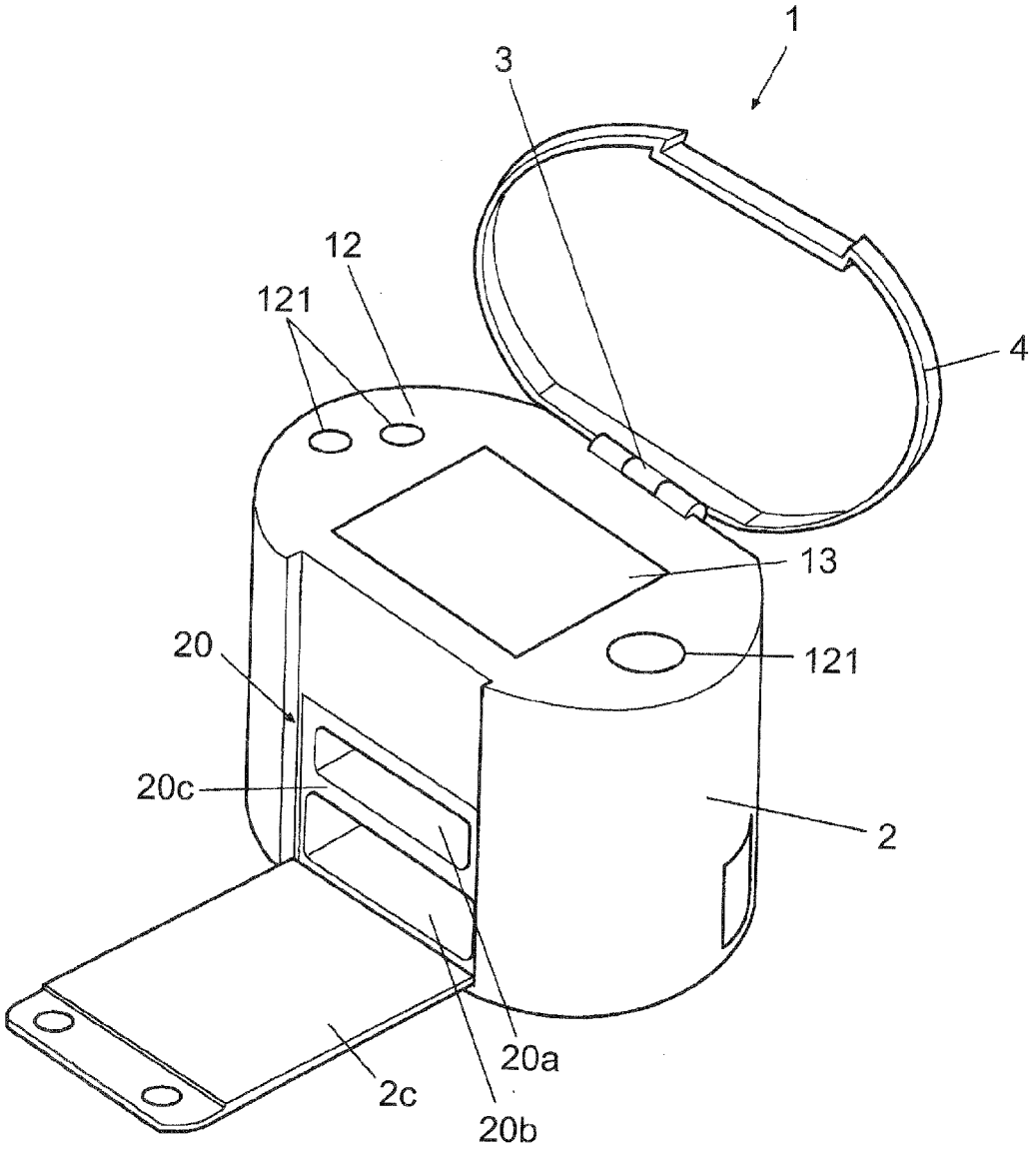
FIG. 1 is a perspective diagram showing an outer appearance of a nail print apparatus of an embodiment of the present invention.

FIG. 1 is a perspective diagram showing an outer appearance of a nail print apparatus of an embodiment of the present invention.

Figure 2:
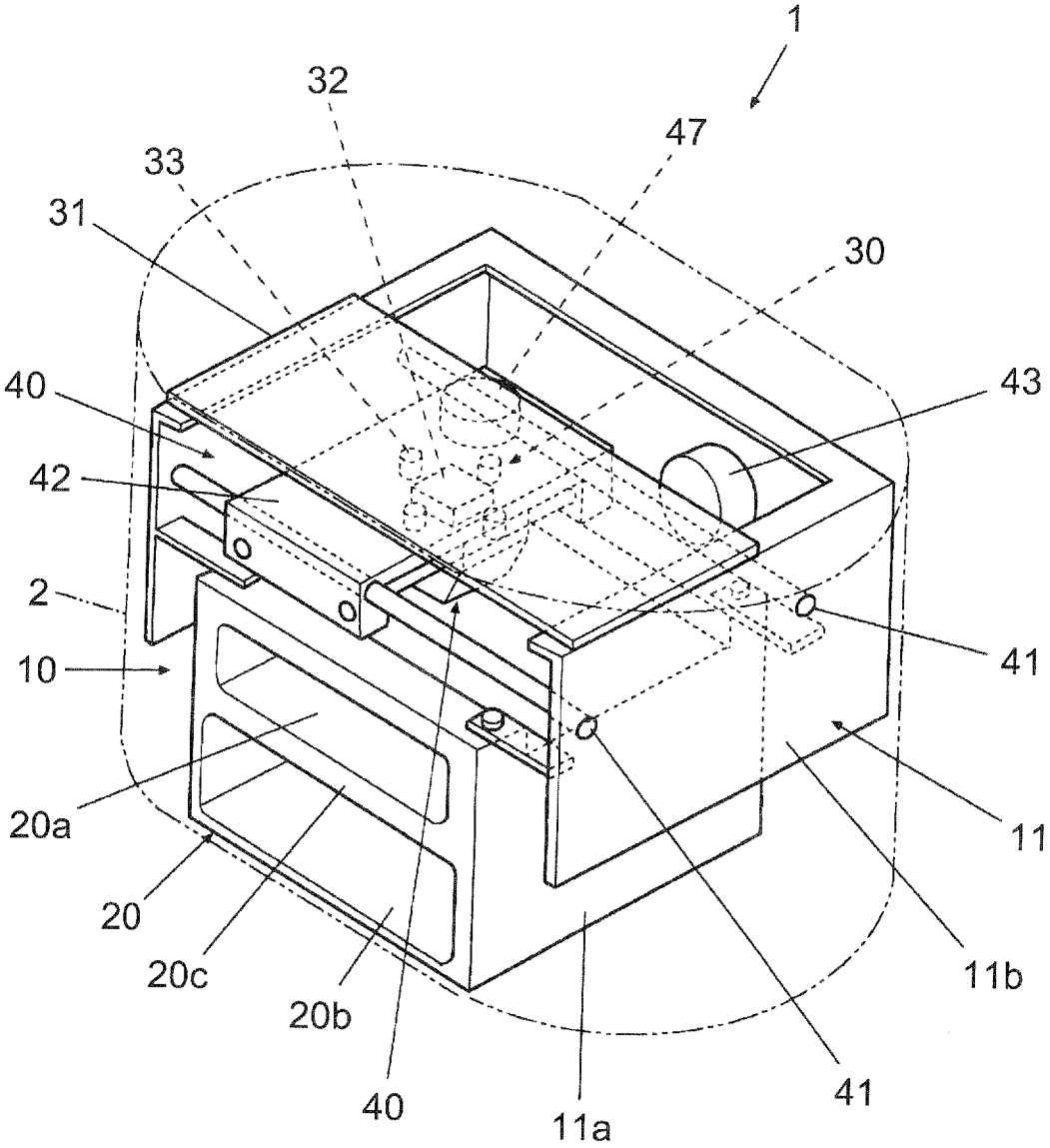
FIG. 2 is a perspective view of an inner configuration of the nail print apparatus of the present embodiment.

FIG. 2 is a perspective view of an inner configuration of the nail print apparatus of the present embodiment.

Figure 3:
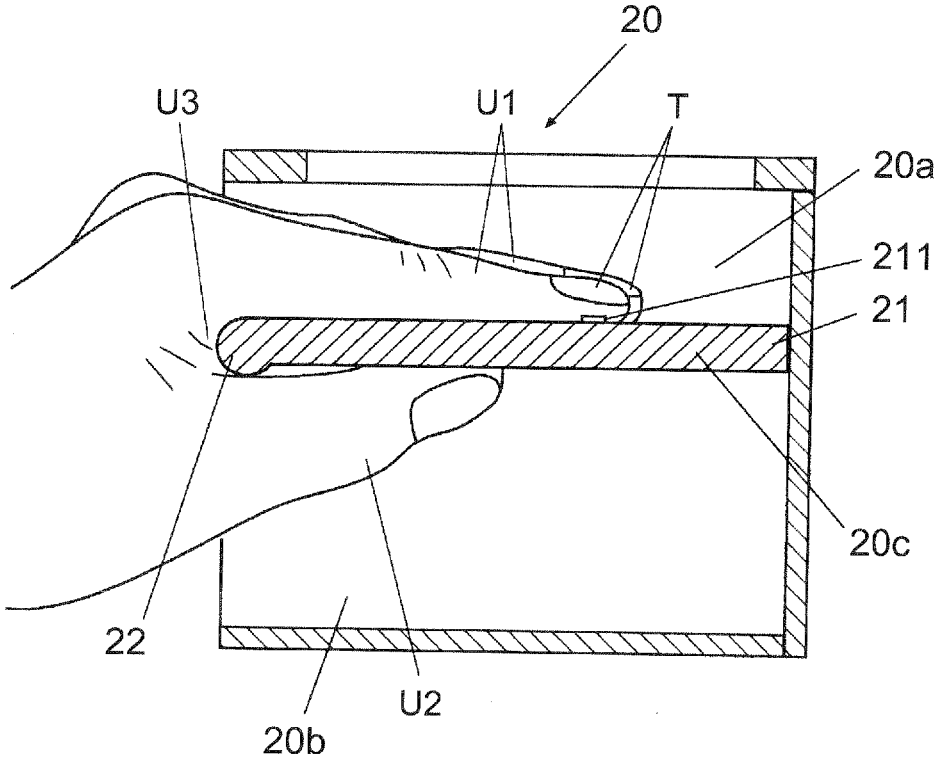
FIG. 3 is a cross sectional view of a print finger fixing section of the nail print apparatus of the present embodiment when the fingers from the index finger to the little finger are inserted in the print finger inserting section as the print fingers.

FIG. 3 is a cross sectional view of a print finger fixing section of the nail print apparatus of the present embodiment when the fingers from the index finger to the little finger are inserted in the print finger inserting section as the print fingers.

As shown in FIG. 1, the nail print apparatus 1 of the present embodiment includes a case main body 2 and a lid 4. The case main body 2 and the lid 4 are connected to each other through a hinge 3 provided in the upper surface rear end of the case main body 2.

The case main body 2 is formed in an oval shape from a planar view. An opening/closing plate 2*c* is provided so as to be able to stand and lay down on a front side of the case main body 2. The opening/closing plate 2*c* is connected to the case main body 2 through a hinge provided on the front surface bottom end of the case main body 2. The opening/closing plate 2*c* is for opening and closing the front surface of the case main body 2.

A later described operating section 12 is provided on a top plate 2*f* of the case main body 2, and a display section 13 is set in approximately the center portion of the top plate 2*f*.

The shape and configuration of the case main body 2 and the lid 4 are not limited to those illustrated above.

An apparatus main body 10 of the nail print apparatus 1 is included in the case main body 2.

Figure 6:
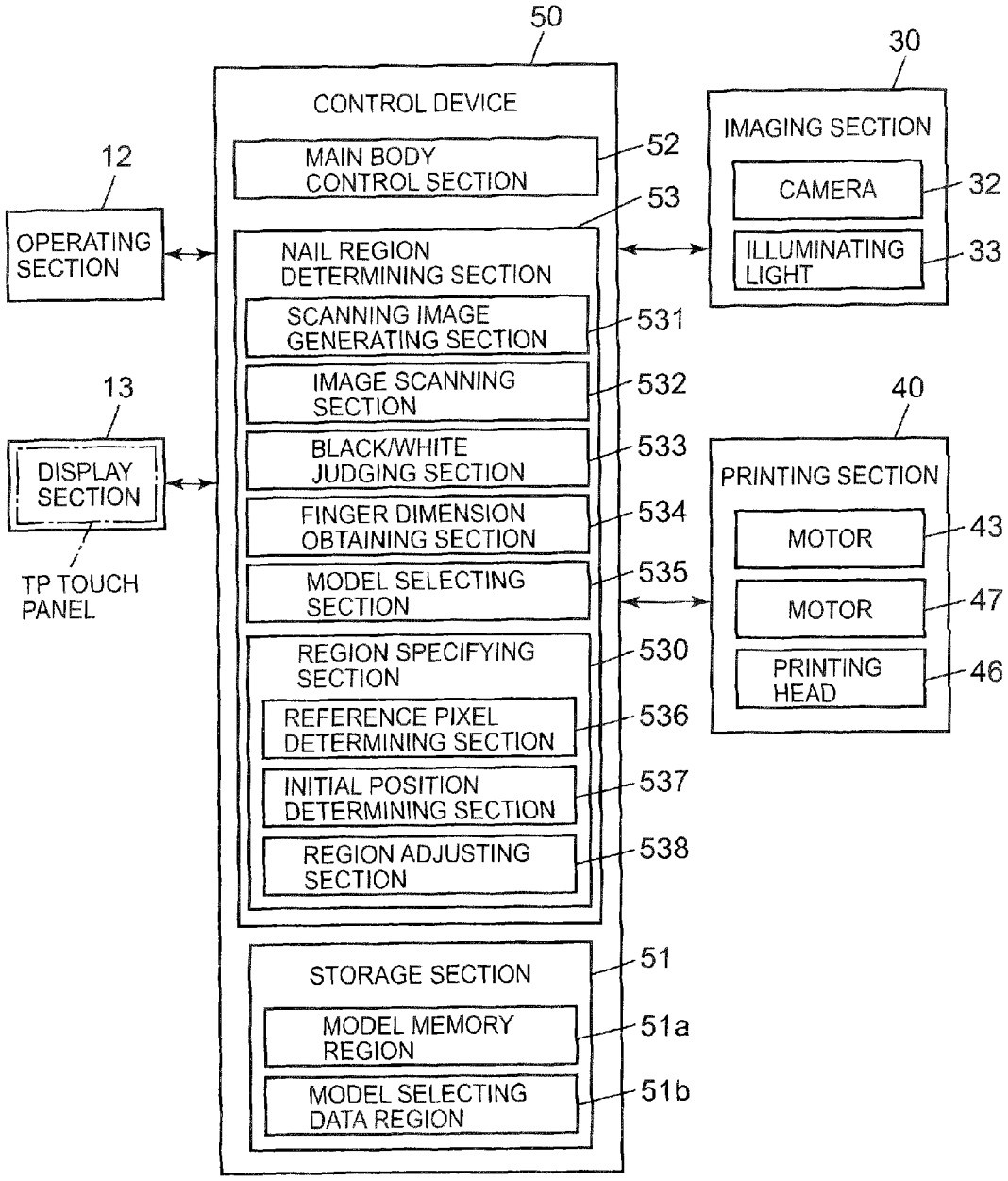
FIG. 6 is a block diagram of a main section showing a configuration of a control device of the nail print apparatus of the present embodiment.

The apparatus main body 10 includes a print finger fixing section 20, an imaging section 30 and a printing section 40 as shown in FIG. 2 and a control device 50 (see FIG. 6).

The print finger fixing section 20, the imaging section 30, the printing section 40 and the control device 50 are provided in the device casing 11.

The device casing 11 includes a lower portion device casing 11*a* and an upper portion device casing 11*b*.

The lower portion device casing 11*a* is formed in a box shape, and provided in a lower portion inside the case main body 2. The upper portion device casing 11*b* is provided above the lower portion device casing 11*a* in an upper portion inside the case main body 2.

The print finger fixing section 20 is provided in the lower portion device casing 11*a* of the device casing 11.

The print finger fixing section 20 includes a print finger inserting section 20*a*, a non-print finger inserting section 20*b* and a holding section 20*c* provided in the lower portion device casing 11*a*.

The print finger inserting section 20*a* is a finger inserting section to insert a finger U1 (hereinafter referred to as "print finger") corresponding to a nail T to be printed (see FIG. 3).

A base (print finger placing surface) of the print finger inserting section 20*a* functions as a finger placing section to place the print finger U1.

The imaging and the printing of the print finger U1 is performed in a state where the print finger U1 is placed on the print finger placing surface of the print finger inserting section 20*a*.

It is preferable that the print finger placing surface, on which the print finger U1 of the print finger inserting section 20*a* is placed, is formed with a color with a large difference in brightness from the color of the finger or the nail such as white, gray, black, etc. so that the boundary between the print finger U1 and the background is clear when the print finger U1 is imaged.

The non-print finger inserting section 20*b* is a finger inserting section to insert a finger U2 other than the print finger (hereinafter referred to as "non-print finger") (see FIG. 3).

The holding section 20*c* is a portion which can be held between the print finger U1 inserted in the print finger inserting section 20*a* and the non-print finger U2 inserted in the non-print finger inserting section 20*b*.

According to the present embodiment, the holding section 20*c* includes a partition wall 21 which divides the print finger inserting section 20*a* and the non-print finger inserting section 20*b*.

The upper surface of the partition wall 21 composes a flat print finger placing surface.

A positioning marker 211 for positioning the print finger U1 is provided on the upper surface of the partition wall 21 which composes the print finger placing surface (see later described FIG. 20).

The positioning marker 211 can be any type of marker which can be used for positioning the print finger U1, and the shape and position is not limited. The positioning marker 211 can be a depressed section or a protruded section provided on the upper surface of the partition wall 21.

When the user inserts the print finger U1 while confirming the image obtained by the imaging section 30 on the display section 13, the positioning marker 211 can simply be a planar mark printed in a color which can be discriminated from the color of the print finger placing surface.

A striking member for positioning by striking the member with a tip of the print finger U1 can be provided on the upper surface of the partition wall 21 instead of the positioning marker 211.

As shown in FIG. 3, a projecting section 22 is formed in an end of the partition wall 21 on a side that the finger is inserted. The projecting section 22 is formed in a portion where a base U3 of the print finger U1 and the non-print finger U2 comes into contact with when the print finger U1 and the non-print finger U2 are deeply inserted in the print finger inserting section 20*a* and the non-print finger inserting section 20*b*.

The cross section of the projecting section 22 in the finger inserting direction is, for example, a circular shape projecting downward from a lower surface of the partition wall 21. With this, the partition wall 21 (holding section 20*c*) can be firmly held between the print finger U1 and the non-print finger U2 in a state where the entire pulp of the print finger U1 is in contact with the print finger placing surface. The shape of the cross section of the projecting section 22 is not limited to a circular shape and can be an oval shape, a non-circular shape such as a polygon, or the like.

For example, when four fingers (index finger, middle finger, ring finger and little finger) other than the thumb of the left hand are the print fingers U1, as shown in FIG. 3, the user inserts the four print fingers U1 in the print finger inserting section 20*a* and the user inserts the thumb which is the non-print finger U2 in the non-print finger inserting section 20*b*. In this case, the user holds the holding section 20*c* between the print fingers U1 inserted in the print finger inserting section 20*a* and the non-print finger U2 inserted in the non-print finger inserting section 20*b* and the print fingers U1 are fixed on the holding section 20*c*.

When only the thumb is the print finger U1, the thumb (print finger U1) is inserted in the print finger inserting section 20*a* and the four fingers other than the thumb (non-print fingers U2) are inserted in the non-print finger inserting section 20*b*. In this case also, the user holds the holding section 20*c* between the print finger U1 and the non-print fingers U2 and the print finger U1 is fixed.

Figure 4:
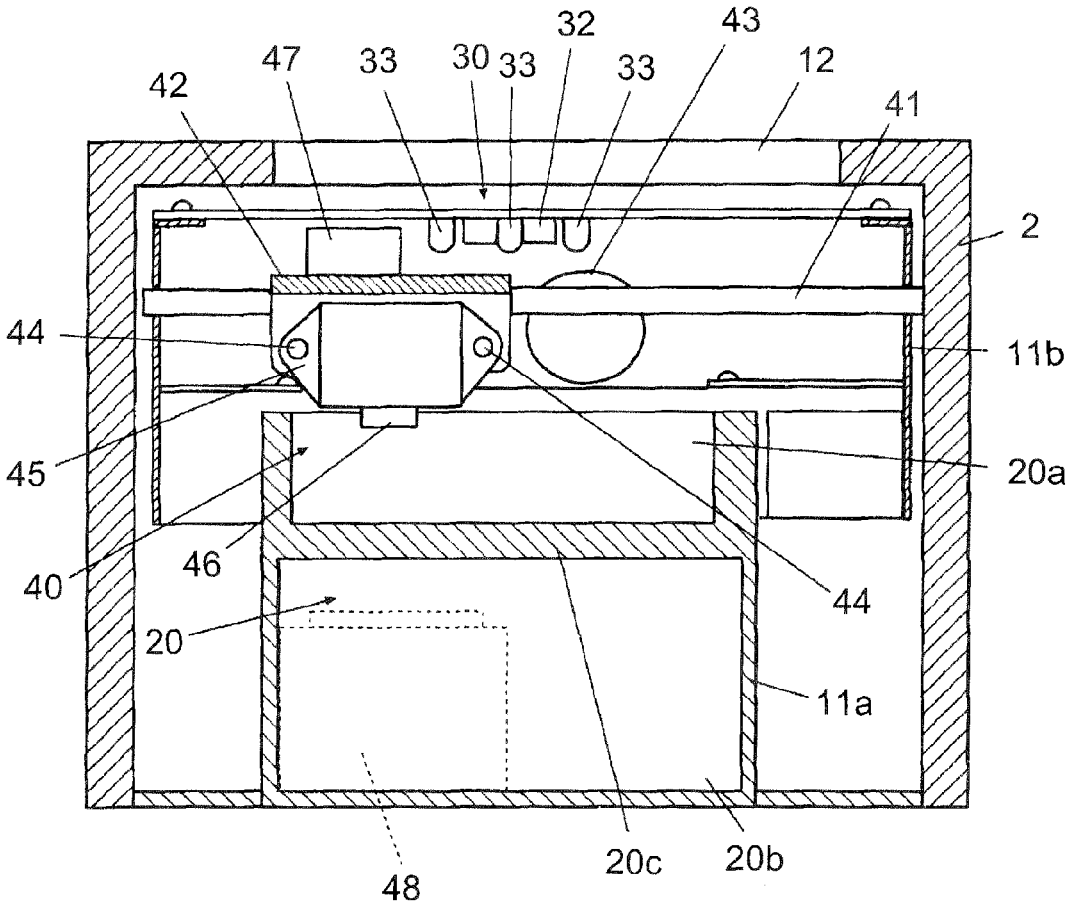
FIG. 4 is a cross sectional view of the front side of the nail print apparatus of the present embodiment.

FIG. 4 is a cross sectional view of the front side of the nail print apparatus of the present embodiment.

Figure 5:
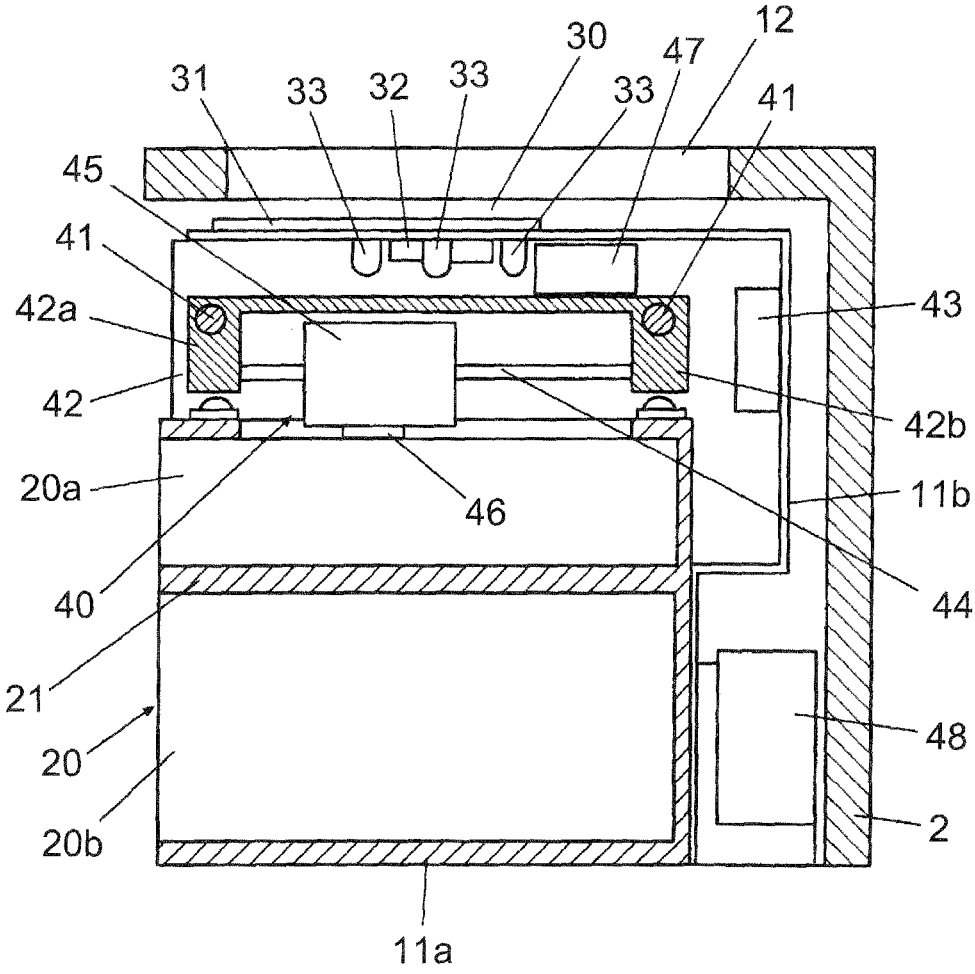
FIG. 5 is a cross sectional view of a side of the nail print apparatus of the present embodiment.

FIG. 5 is a cross sectional view of a side of the nail print apparatus of the present embodiment.

As shown in FIG. 4 and FIG. 5, an imaging section 30 is provided in the upper portion device casing 11*b* of the device casing 11.

A camera 32 with, for example, about two million or more pixels including a driver is provided on a lower surface of a center section of a substrate 31 provided in the upper portion device casing 11*b*.

An illuminating light 33 such as a white LED, etc. is provided to surround the camera 32 on the substrate 31. The imaging section 30 includes the camera 32 and the illuminating light 33.

The imaging section 30 illuminates the print finger U1 placed in the print finger inserting section 20*a* which is the finger placing section with the illuminating light 33 and images the print finger U1 with the camera 32 to obtain the finger image. The imaging section 30 is connected to a later described main body control section 52 of the control device 50 and the main body control section 52 controls the imaging section 30.

The printing section 40 performs printing such as color, pattern, etc. on a nail region Ta (see FIG. 24) which is a print region finally determined by a later described nail region determining section 53. The printing section 40 is provided mainly in the upper portion device casing 11*b*.

As shown in FIG. 4 and FIG. 5, two guide rods 41 are provided parallel to each other to bridge both side plates of the upper portion device casing 11*b*. A main carriage 42 is provided on the guide rods 41 so as to be able to slide. As shown in FIG. 5, two guide rods 44 are provided parallel to each other to bridge a front wall 42*a* and a rear wall 42*b* of the main carriage 42. A sub-carriage 45 is provided on the guide rods 44 so as to be able to slide. A printing head 46 is provided on a lower surface of a center section of the sub-carriage 45.

According to the present embodiment, the printing head 46 is a printing head of an inkjet method which forms ink into small drops and prints on a medium to be printed by directly spraying ink. The recording method of the printing head 46 is not limited to the inkjet method.

The main carriage 42 is connected to the motor 43 through a power transmission member. The main carriage 42 moves in a left and right direction along the guide rods 41 by a regular and reverse rotation of the motor 43. The sub-carriage 45 is connected to the motor 47 through a power transmission member. The sub-carriage 45 moves in a front and rear direction along the guide rods 44 by a regular and reverse rotation of the motor 47.

An ink cartridge 48 to supply ink to the printing head 46 is provided to the lower portion device casing 11*a*. The ink cartridge 48 is connected to a printing head 46 through an ink supplying tube not shown and suitably supplies ink to the printing head 46. The ink cartridge may be mounted to the printing head 46 itself.

The printing section 40 includes guide rods 41, a main carriage 42, a motor 43, guide rods 44, a sub-carriage 45, a printing head 46, a motor 47, an ink cartridge 48 and the like. The motor 43, the printing head 46, and the motor 47 of the printing section 40 are connected to a later described main body control section 52 of the control device 50 and the main body control section 52 controls the above.

The operating section 12 is an input section which receives various input from the user.

The operating section 12 is provided with, for example, a power source switch button to turn the power of the nail print apparatus 1 to ON, a stop switch button to stop the operation, and operating buttons 121 to receive other various input.

According to the present embodiment, a touch panel TP is provided as one with the display section 13 on the surface of the display section 13 and various input can be received by touch operation with a stylus pen, etc. which is not shown.

For example, various operating buttons such as a print switch button, a terminate switch button to terminate operation, a pattern selecting switch button for the user to select a nail image pattern to be printed (in other words, the design desired to be printed on the nail region Ta which is the print target region) are displayed on the display screen of the display section 13. The user can perform various input by touching the operating buttons on the display screen of the display section 13.

According to the present embodiment, a finger image is displayed on the display screen of the display section 13 and touch operation by touching with a stylus pen, etc. along the outline of the nail region Ta of the finger image enables input of a plurality of later described feature points P with predetermined intervals.

The display section 13 is a display section including, for example, a liquid crystal panel, etc. (LCD: liquid crystal display).

For example, the display section 13 displays a finger image imaging the print finger U1, an image overlapping the nail region extracting model M on the finger image (see FIG. 23, etc.), a final nail region Ta (see FIG. 24, etc.), a nail image pattern to be printed on the nail region Ta of the print finger U1, a design confirmation thumbnail image and the like.

As described above, the touch panel TP is provided as one with the display section 13.

For example, the control device 50 is provided in the substrate 31, etc. provided in the upper portion device casing 11*b*.

FIG. 6 is a block diagram of a main section showing a configuration of a control device of the nail print apparatus of the present embodiment.

The control device 50 is a computer including a storage section 51 composed of a CPU (Central Processing Unit) not shown and also a ROM (Read Only Memory), a RAM (Random Access Memory), and the like (all not shown).

The storage section 51 stores data such as a nail image pattern to be printed, and various programs such as a nail region determining program, print program, etc. The control device 50 performs the programs to control each section of the nail print apparatus 1.

The control device 50 functions as a print control section to specify the nail region Ta in the finger image and to control the printing section 40 to perform printing on the region specified as the nail region Ta on the print finger U1 of the user.

As described later, the control device 50 further functions as a storage control section to generate the nail region extracting model M and to store the nail region extracting model M corresponding a coordinate position of the plurality of feature points P with a number of the feature point P in a model memory region 51*a* of the storage section 51.

According to the present embodiment, the control device 50 includes functional sections such as the main body control section 52, a nail region determining section 53, and the like.

According to the present embodiment, as shown in FIG. 6, various storage regions such as the model memory region 51*a*, model selecting data region 51*b*, etc. are provided in the storage section 51.

The model memory region 51*a* is a storage region storing plurality of nail region extracting models M (see FIG. 13, etc.), learning model file, and number, coordinate information of reference point Pd (see FIG. 16) and the like which are described later.

The nail region extracting model M is used for specifying (determining) the nail region Ta from the finger image.

Extracting and specifying of the nail region can be performed fast and highly accurately by using a nail region extracting model M close to the nail region of the user. However, characteristics such as size and shape of the nail region are different depending on the sex of the user (male or female), physique of the user (for example, fat or thin), etc.

According to the present embodiment, the following five types of nail region extracting models M with outlines different from each other are stored in the model memory region 51*a*, a nail region extracting model M1 for fat people, a nail region extracting model M2 for males, a nail region extracting model M3 for females, a nail region extracting model M4 for thin people, a nail region extracting model M5 for children (6 years old or younger).

Below, when simply the "nail region extracting model M" is referred, the five types of nail region extracting models M1 to M5 are all included.

The nail region extracting model M is not limited to the above five types. For example, a nail region extracting model M further divided according to age range (tens, thirties, fifties, etc.) can be stored.

The nail region extracting model M can be prepared for each nail of each finger (thumb, index finger, middle finger, ring finger, little finger).

The present invention is not limited to preparing all of the nail region extracting models M illustrated here and, for example, only the nail region extracting model M2 for males and the nail region extracting model M3 for females may be stored in the model memory region 51*a*.

The model selecting data region 51*b* is a storage region which stores various pieces of data necessary to perform the model selecting process where a nail region extracting model M suitable for the finger of the user is selected among a plurality of nail region extracting models M stored in the model memory region 51*a*.

According to the present embodiment, a nail region extracting model M suitable for the user is selected from the above five types of nail region extracting models (M1 to M5) stored in the model memory region 51*a* of the storage section 51 based on the dimension of the print finger U1 of the user.

Therefore, the model selecting data region 51*b* stores the value of maximum finger width (in other words, width dimension of a widest portion of the finger) corresponding to each nail region extracting model M as threshold value for selecting the nail region extracting model to be used as data when selecting the nail region extracting model M.

It is statistically known that the width of the finger is different according to sex and difference in physique (regarding sex, see for example, "Human Characteristics Database" by National Institute of Technology and Evaluation). Therefore, the nail region extracting model M suitable for the user can be selected by estimating the sex, physique, etc. of the user from the maximum finger width.

Specifically, according to the present embodiment, when the maximum finger width of the print finger U1 of the user is 20 mm or more, the nail region extracting model M1 for fat people is applied. When the maximum finger width of the print finger U1 of the user is 18 mm or more and less than 20 mm, the nail region extracting model M2 for males is applied. When the maximum finger width of the print finger U1 of the user is 15 mm or more and less than 18 mm, the nail region extracting model M3 for females is applied. When the maximum finger width of the print finger U1 of the user is 13 mm or more and less than 15 mm, the nail region extracting model M4 for thin people is applied. When the maximum finger width of the print finger U1 of the user is less than 13 mm, the nail region extracting model M5 for children (6 years old or younger) is applied. As described above, the threshold value of the maximum finger width of the finger is predetermined for each of the nail region extracting models M1 to M5 and the threshold value is stored in the model selecting data region 51*b*.

The data for selecting the nail region extracting model M suitable for the user among the nail region extracting models M (M1 to M5) stored in the model selecting data region 51*b* is not limited to data illustrated above. The threshold values for selecting the nail region extracting model M are not limited to those illustrated here and can be suitably modified.

The nail region extracting model M can be generated in advance as default before the nail print apparatus 1 is shipped from the factory, and can be stored in the model memory region 51*a* of the storage section 51 of the nail print apparatus 1 to be shipped.

The nail region extracting model M can be generated in the nail print apparatus 1 by the user using the apparatus, and can be stored in the model memory region 51*a* of the storage section 51.

The method of generating the nail region extracting model M in the nail print apparatus 1 is described below.

Figure 7:
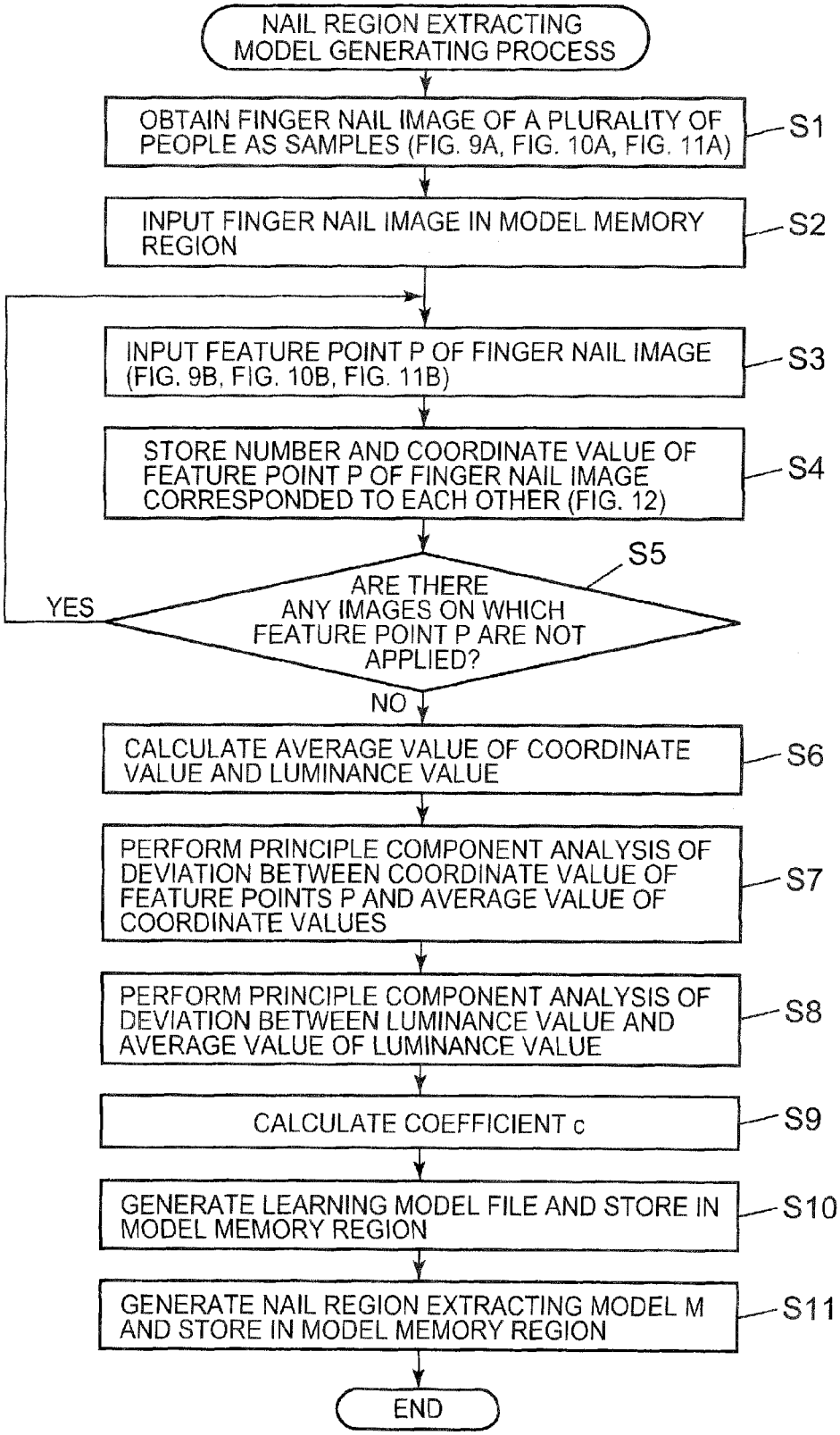
FIG. 7 is a flowchart showing the generating process of the nail region extracting model of the present embodiment.

FIG. 7 is a flowchart showing the generating process of the nail region extracting model of the present embodiment.

Figure 8:
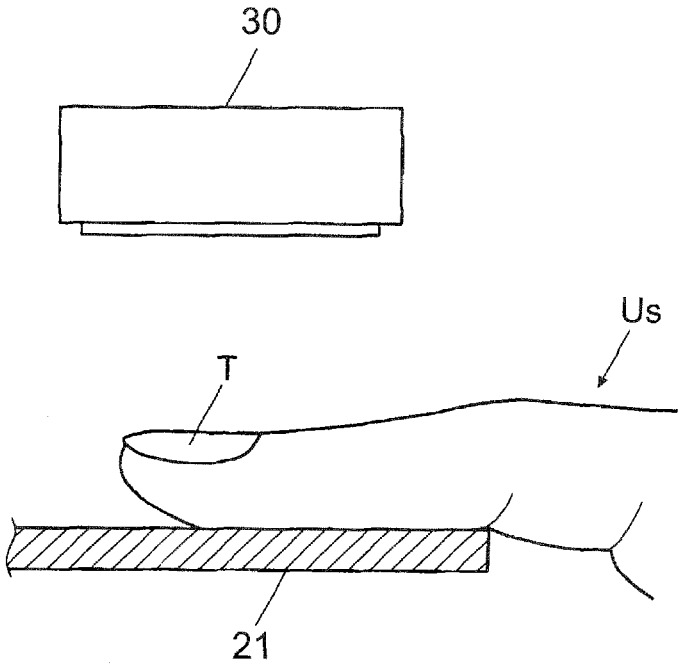
FIG. 8 is a side view schematically showing the configuration of the main section to obtain the finger image as a sample.

FIG. 8 is a side view schematically showing the configuration of the main section to obtain the finger image as a sample.

Figure 9A:
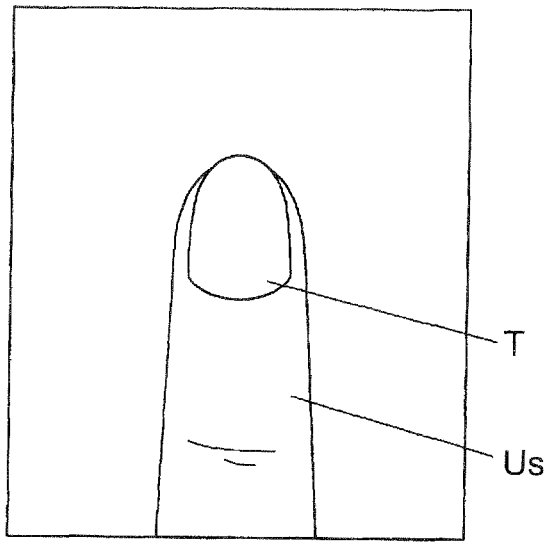
FIG. 9A is a first example of a finger image of a plurality of people as samples.

FIG. 9A is a first example of finger images of a plurality of people as samples.

Figure 9B:
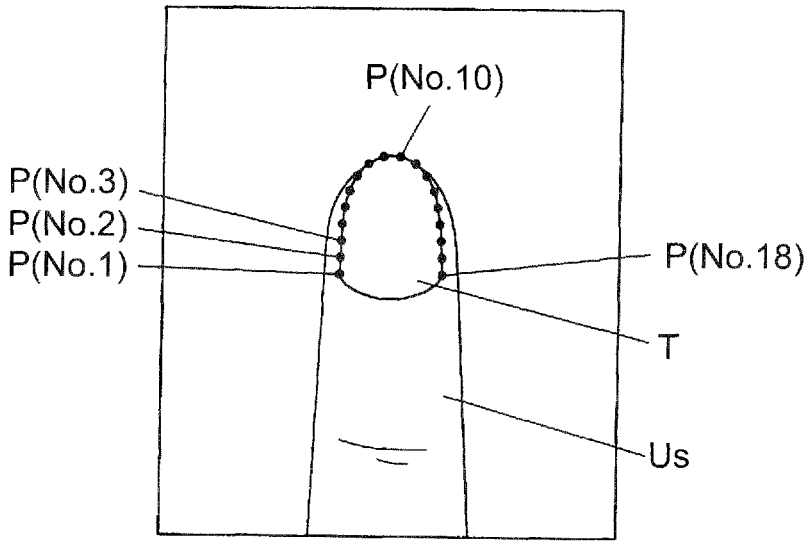
FIG. 9B is a diagram showing a state of positioning feature points P along an outline of the nail in the finger image of FIG. 9A.

FIG. 9B is a diagram showing a state of positioning feature points P along an outline of the nail in the finger image of FIG. 9A.

Figure 10A:
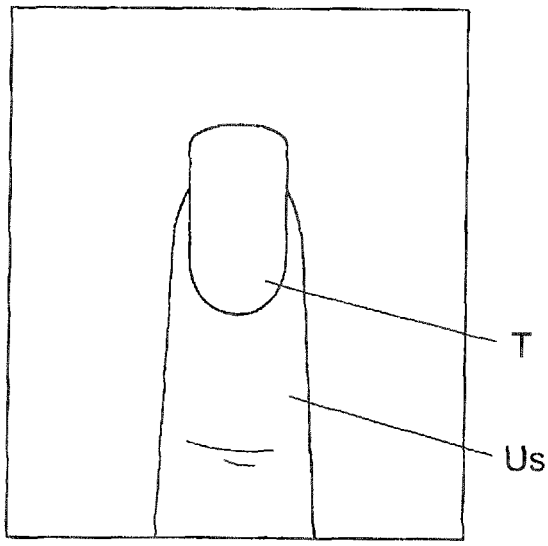
FIG. 10A is a second example of a finger image of a plurality of people as samples.

FIG. 10A is a second example of finger images of a plurality of people as samples.

Figure 10B:
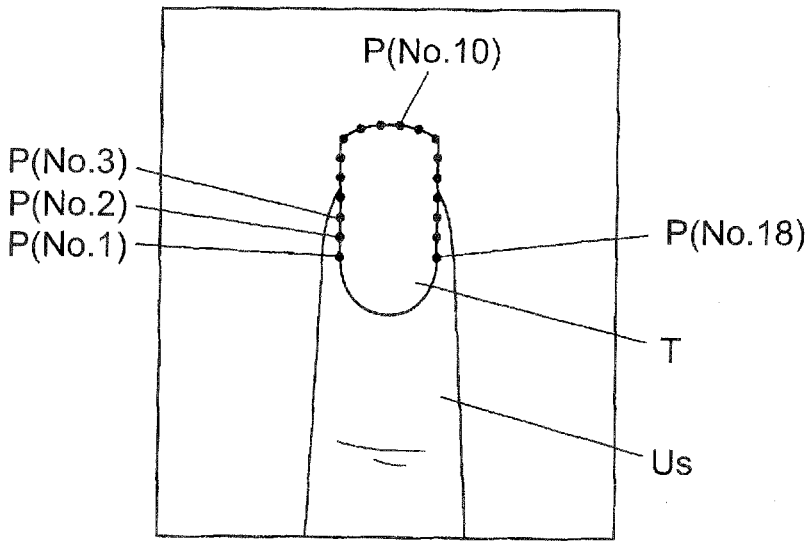
FIG. 10B is a diagram showing a state of positioning feature points P along an outline of the nail in the finger image of FIG. 10A.

FIG. 10B is a diagram showing a state of positioning feature points P along an outline of the nail in the finger image of FIG. 10A.

Figure 11A:
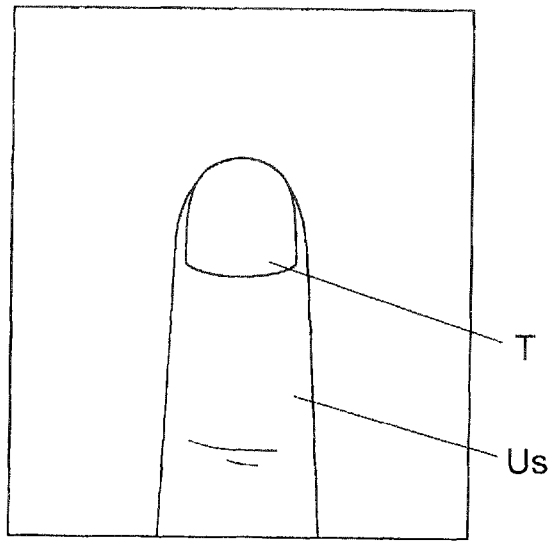
FIG. 11A is a third example of a finger image of a plurality of people as samples.

FIG. 11A is a third example of finger images of a plurality of people as samples.

Figure 11B:
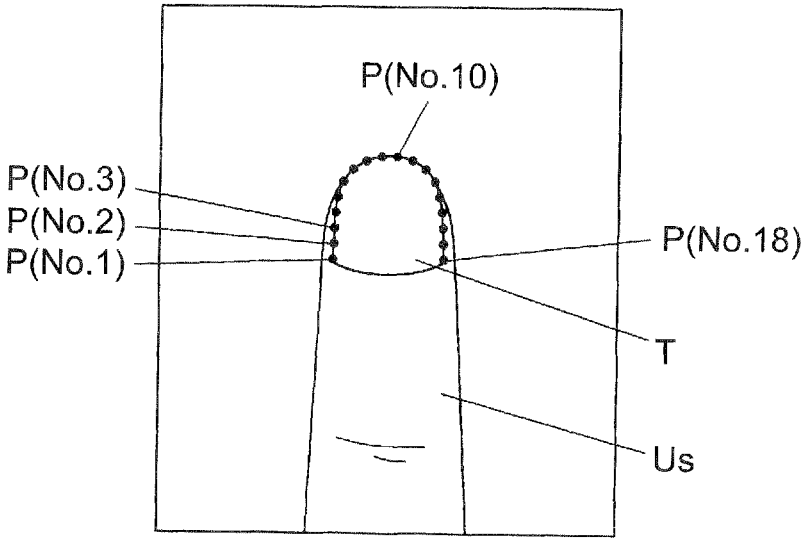
FIG. 11B is a diagram showing a state of positioning feature points P along an outline of the nail in the finger image of FIG. 11A.

FIG. 11B is a diagram showing a state of positioning feature point P along an outline of the nail in the finger image of FIG. 11A.

FIG. 12 is a diagram showing an example of a sample file.

As shown in FIG. 7, when the nail region extracting model M is generated, first, finger images of a plurality of people as samples are obtained (in other words, images of finger Us and the nail T, see FIG. 9A, FIG. 10A, and FIG. 11A) (step S1).

Specifically, as shown in FIG. 8, similar to when the user performs the actual printing, a finger Us as a sample is placed in the print finger inserting section 20*a* of the nail print apparatus 1 and the finger Us is imaged with the imaging section 30 to obtain the finger image for the number of people (for example, 30 people).

Here, the number of people from which finger images should be obtained is not limited. However, it is possible to generate a nail region extracting model M which can extract and specify the nail region Ta at a higher accuracy if the number of people is larger, and thus is more preferable.

According to the present embodiment, five types of nail region extracting models M (M1 to M5) as described above are generated and stored in the storage section 51. Therefore, finger images of a plurality of people as samples are obtained for each target group (in other words, males, females, fat people, thin people and children who are 6 years old or younger).

The present embodiment describes an example where only five types of nail region extracting models M1 to M5 are stored in the storage section 51. However, as described above, the nail region extracting model M stored in the storage section 51 is not limited to the five types.

When other nail region extracting models M are stored, finger images of a plurality of people belonging to a corresponding classification can be obtained as samples, and a separate nail region extracting model M for each type can be generated. For example, when a nail region extracting model M for a person in their thirties is generated, finger images of a plurality of people in their thirties are obtained.

The obtained finger image data is input (stored) in the model memory region 51*a* of the storage section 51 of the control device 50 which is the computer (step S2).

Next, as shown in FIG. 9A, FIG. 10A, and FIG. 11A, the obtained finger images are displayed on the display section 13 of the nail print apparatus 1 in order. The user uses the touch panel TP provided on the display section 13 to provide character points P at substantially the same interval along an outline of the nail T of the finger images according to touch operation with a stylus pen, etc. (see FIG. 9B, FIG. 10B, and FIG. 11B). With this, position information of each feature point P of each finger image is input to the control device 50 which is the computer (step S3).

The present embodiment describes an example of inputting the feature point P using a stylus pen, etc. However, the device used for input is not limited to a stylus pen, etc. and input is possible using a pointing device such as a finger, mouse, etc.

As shown in FIG. 9B, FIG. 10B, and FIG. 11B, the outline of the nail T is different according to each individual. However, the number of feature points P provided is the same regardless of the position and shape of the nail T.

According to the present embodiment, the number of feature points P is 18. However, the number of feature points P is not limited to this number. As the number of feature points P increases, the outline of the nail can be represented more finely and a nail region extracting model M with high accuracy can be generated.

The positions of the feature points P are not limited to the illustrated example. For example, the feature points P can also be provided on the bottom side (in other words, between the feature points No. 1 and No. 18) of the nail T so as to surround the outline of the nail T.

As shown in FIG. 9B, FIG. 10B, and FIG. 11B, common numbers (in the present embodiment, No. 1 to No. 18 in order starting from bottom left of the nail T) are applied in order to the feature points P of the finger images. Then, the control device 50 generates a sample file (text file) corresponding the number with each coordinate value of the feature point P and stores the file in the model memory region 51*a* (step S4).

FIG. 12 shows an example of the sample file. For example, a sample file of the finger image of the sample finger Us shown in FIG. 9A corresponds the numbers of the feature points P with the coordinate values of the feature points P represented in FIG. 9B. Here, the coordinate values of the feature points P are corresponded to the positions of the plurality of pixels included in the finger image. The values of an x-coordinate and a y-coordinate of the coordinate values of the feature points P are shown by a pixel number of an X-axis and a pixel number of a Y-axis, where one corner of the finger image is the origin for the plurality of pixels composing the finger image as shown in the later described FIG. 16. Here, the X-axis is the direction along the width direction of the finger and the Y-axis is the direction orthogonal to the X direction and is the direction along the length direction of the finger.

Next, the control device 50 judges whether or not there are any images in which the feature points P are not yet applied among the finger images first input (in the present embodiment, data of 30 people) (step S5).

Then, when the control device 50 judges that there are images in which the feature points P are not applied (step S5; YES), the control device 50 repeats the process of step S3 and step S4 on the finger image in which the feature points P are not applied.

When the control device 50 judges there are no more images in which the feature points P are not applied (step S5; NO), the control device 50 calculates the average value of the coordinate values of the feature points P and the average value of luminance values of the region surrounded by the feature points P in the finger image of each sample file (step S6).

The method of calculating the average value of the coordinate value is, for example after adding the coordinate values of all of the finger images, the result is divided by the number of people for each of the feature points P. In other words, for example, after adding the coordinate values of the first feature point P for 30 people, the result is divided by 30 to obtain the average value of the coordinate values of the first feature point P.

The average value of the luminance value is similarly calculated by adding the luminance value of 30 people and dividing the result by 30.

The control device 50 performs principle component analysis of the deviation between the coordinate value of the feature points P of the finger image of each sample file and the average value of the coordinate value (step S7).

With this, the control device 50 obtains an eigenvector of the averaged coordinate values of the feature points P of the sample file.

The control device 50 performs principle component analysis of the deviation between the luminance value of the region surrounded by the feature points P of the finger image of each sample file and the average value of the luminance value (step S8).

With this, the control device 50 obtains an eigenvector of the averaged luminance value of the sample file.

The processing on the computer can be performed easily and fast by obtaining the eigenvector of the coordinate values and the luminance values.

There is a correlation between the coordinate values of the feature points P, in other words the shape of the region surrounded by the feature points P and the luminance value of the region surrounded by the feature points P. Therefore, when the correlation is unified to one coefficient, the processing on the computer becomes easy.

Therefore, the control device 50 performs principle component analysis of an eigenvalue and an eigenvector of the group of coordinate values of the feature points P and an eigenvalue and an eigenvector of the luminance value of the region surrounded by the feature points P.

With this, the control device 50 calculates the coefficient ("coefficient c" in FIG. 7) as a parameter which can control both the coordinate value of the feature point P and the luminance value of the region surrounded by the feature points P (step S9).

The control device 50 generates a learning model file corresponding to each sample file, the learning model file including the eigenvalue and the eigenvector of the averaged coordinate value group of the feature points P of the finger images, the eigenvalue and the eigenvector of the averaged luminance value of the region surrounded by the feature points P of the finger image, the eigenvalue and the eigenvector of the principle component score of the coordinate value of the feature point P and the luminance value of the region, various coefficients (for example, vector dimension value unifying coefficient c, normalizing coefficient, etc.), the average value of the coordinate values of the feature points P, the average value of the luminance value of the region surrounded by the feature points P, and the like.

In the present embodiment, 30 files of learning model files are generated corresponding to each sample file for 30 people. Then, the generated learning model files are stored in the model memory region 51*a* (step S10).

Next, the control device 50 stores an average shape of the region surrounded by the feature points P based on the average value of the coordinate values of the feature points P of the finger images of the sample files calculated in step S6 (represented by the coordinate value after averaging process in step S6) as the nail region extracting model M in the model memory region 51*a* (step S11).

The nail region extracting model M can be a model which simply averages the coordinate values of the feature points P. However, in order to obtain a model with high accuracy and universality, warping process can be performed to correct the characteristic value where there is difference in each individual by considering the entire outline and balance.

Next, the example of the nail region extracting model M is described.

Figure 13:
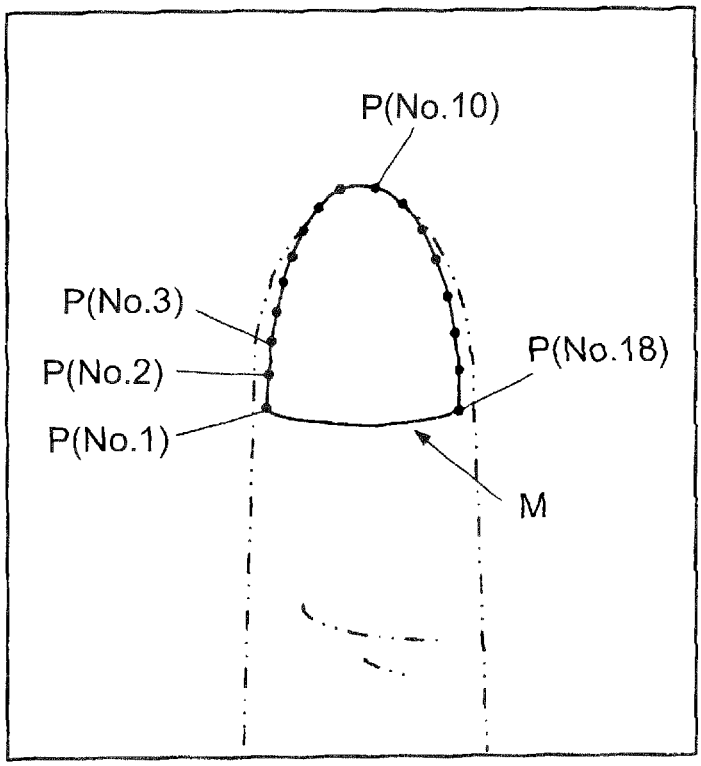
FIG. 13 is a diagram showing an example of a nail region extracting model.

FIG. 13 schematically shows an example of the nail region extracting model M.

In FIG. 13, for reasons of convenience in illustration, a solid line represents the region surrounded by the feature points P of the nail region extracting model M and a long and two short dashes line represents the entire finger.

Figure 14A:
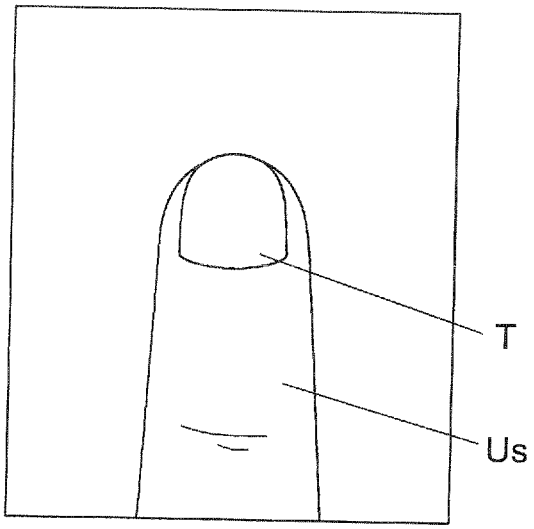
FIG. 14A is a diagram showing an example of finger images of a plurality of males as samples for generating a nail region extracting model for males.

FIG. 14A is a diagram showing an example of finger images of a plurality of males as samples for generating a nail region extracting model for males.

Figure 14B:
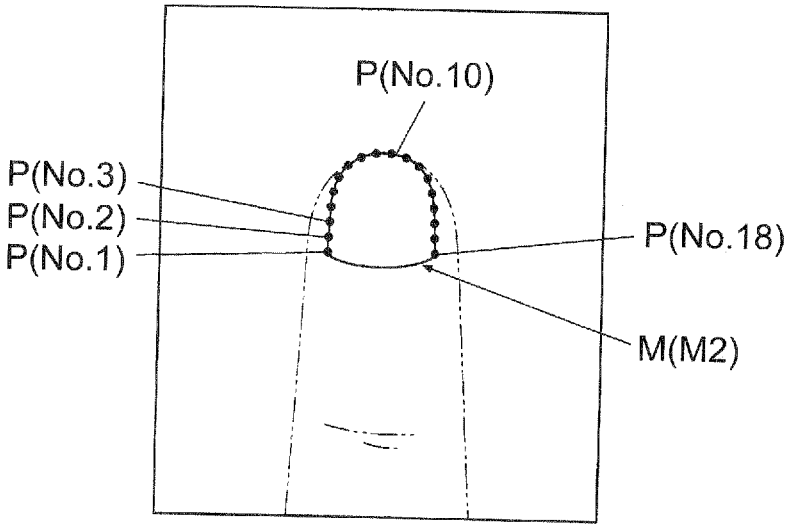
FIG. 14B is a diagram showing an example of a nail region extracting model for males.

FIG. 14B is a diagram showing an example of a nail region extracting model M2 for males generated based on the finger images of a plurality of males as samples.

Figure 15A:
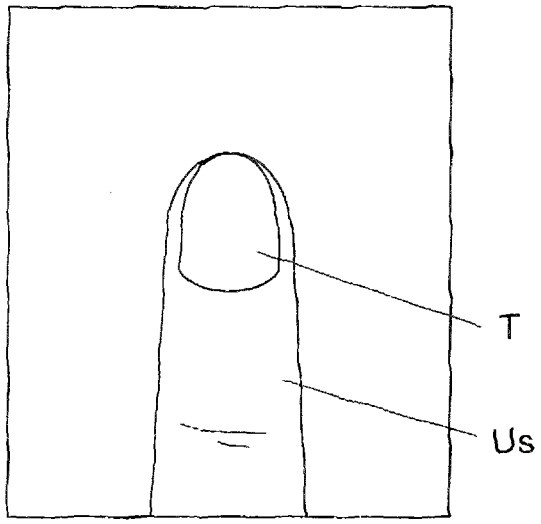
FIG. 15A is a diagram showing an example of finger images of a plurality of females as samples for generating a nail region extracting model for females.

FIG. 15A is a diagram showing an example of finger images of a plurality of females as samples for generating a nail region extracting model for females.

Figure 15B:
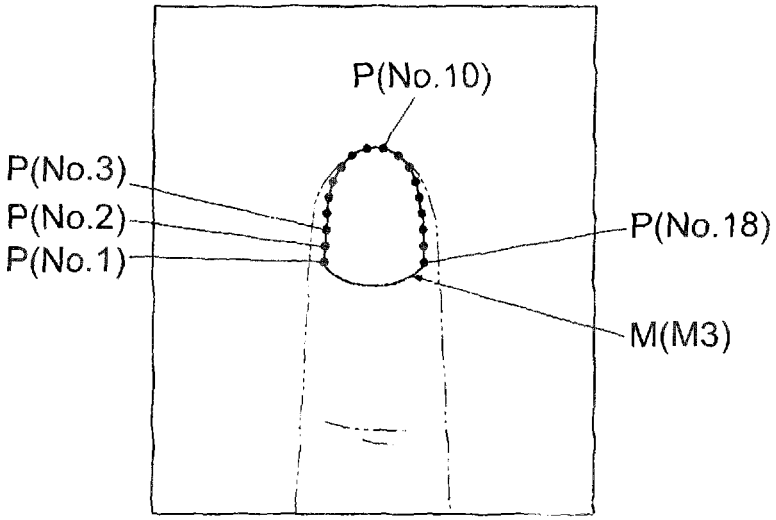
FIG. 15B is a diagram showing an example of a nail region extracting model for females.

FIG. 15B is a diagram showing an example of a nail region extracting model M3 for females generated based on the finger images of a plurality of females as samples.

Figure 16:
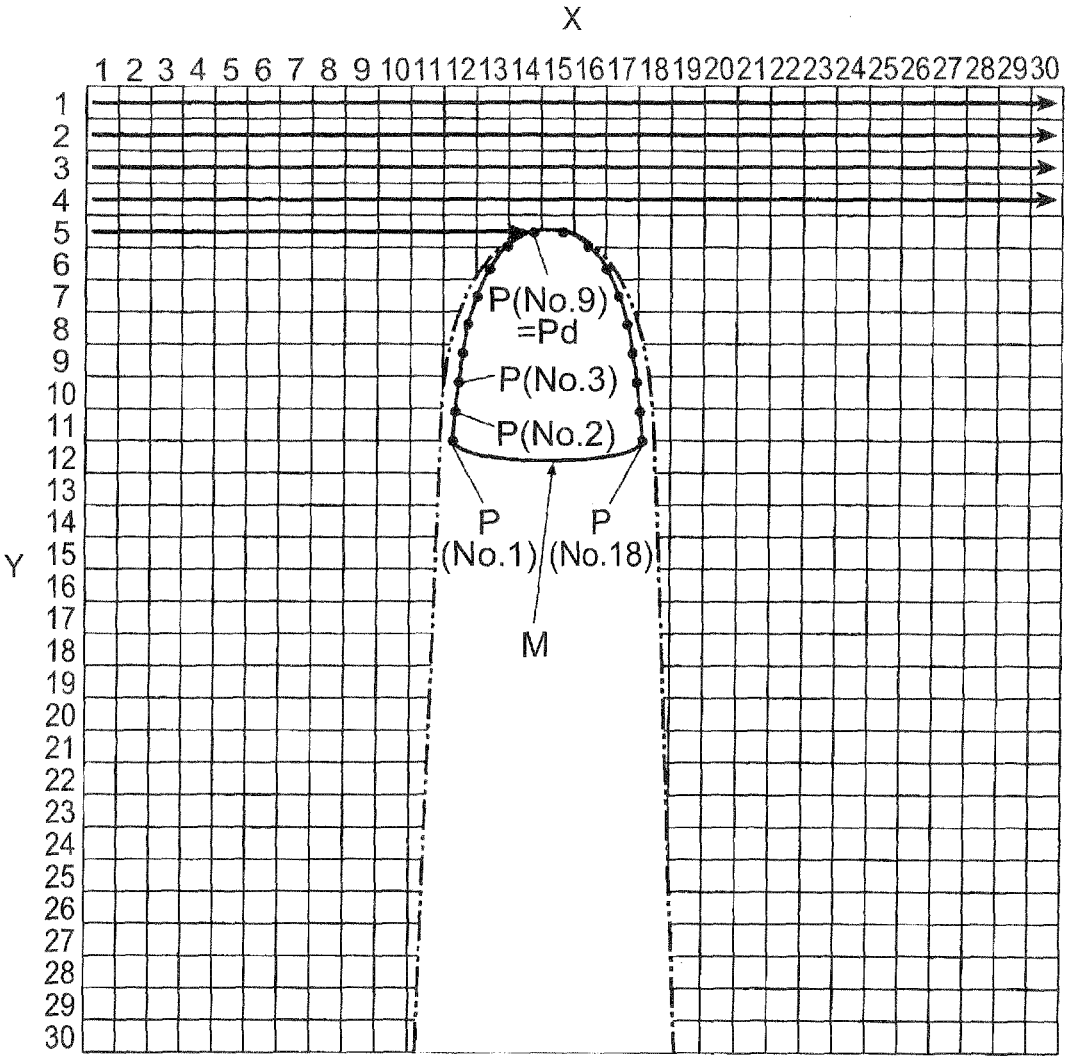
FIG. 16 is an explanatory diagram for explaining an example of a method of scanning the nail region extracting model to set a reference point.

FIG. 16 is an explanatory diagram for explaining an example of a method of scanning the nail region extracting model to set a reference point.

Each nail region extracting model M1 to M5 includes an outline (in the present embodiment, line connecting the feature points P) with a shape different from each other for each group classification used as samples.

For reasons of convenience in illustration, FIG. 16 shows the finger image including 30 pixels in the X direction, 30 pixels in the Y direction and 900 pixels (=30×30) in total. Actually, the number of pixels of the finger image includes the number of pixels corresponding to the number of pixels of the camera 32 of the imaging section 30, for example, number of pixels of about two million pixels or more. Here, as shown in FIG. 16, the X-axis is a direction along the width direction of the finger and the Y-axis is a direction orthogonal to the X-axis and a direction along the length direction of the finger. The coordinate value of the feature point P is shown with a number of the pixel of the X-axis and the number of the pixel of the Y-axis with one corner (in FIG. 16, upper left corner) of the finger image as the origin.

For example, as shown in FIG. 16, the control device 50 scans the region surrounded by the feature points P as the nail region extracting model M in a predetermined order. In the present embodiment, the control device 50 sequentially scans from the top line of the image one line at a time from left to right. The feature point P first detected is to be the reference point Pd and the number of the reference point Pd and the coordinate value are stored in the model memory region 51*a*.

Here, the scanning of the nail region extracting model M can be performed by a later described image scanning section 532.

FIG. 16 shows an example when a feature point P is first detected when the fifth line is scanned.

In FIG. 16, the feature point P is the ninth point, and is represented by the coordinate values with the coordinate in the x-axis direction as x=14 and the coordinate in the y-axis direction as y=5.

Therefore, in this case, the number 9 of the feature point P and the coordinate values which are x=14, y=5 are stored in the model memory region 51*a* as the reference point Pd.

The method of determining the reference point Pd is not limited to the above.

For example, the nail region extracting model M can be displayed on the display screen and the user can touch any of the feature point P with the stylus pen, etc. to select the feature point P as the reference point Pd with the control device 50.

For example, when the control device 50 sequentially scans the image from the top line one line at a time from the left to the right when a reference pixel Cd of the finger image is set as described later, the user confirms the nail region extracting model M on the display screen and touches the feature point P which is considered by sight to be in the position to the most upper left to select the feature point P as the reference point Pd suitable to be overlapped with the reference pixel Cd.

The main body control section 52 realizes various processing by each section of the nail print apparatus 1. The main body control section 52 functions as an imaging control section to control the imaging section 30 to obtain the finger image, a printing control section to control the printing section 40 to print on the nail region Ta, a display control section to control the display of the display section 13, and the like.

The nail region determining section 53 is a functional section to determine the nail region Ta which is to be the print target. The nail region determining section 53 fits the nail region extracting model M stored in the model memory region 51*a* of the storage section 51 to the finger image of the user obtained by the imaging section 30 to determine the nail region Ta which is to be the print target.

According to the present embodiment, the nail region determining section 53 includes functional sections of, a scanning image generating section 531, an image scanning section 532, a black/white judging section 533, a finger dimension obtaining section 534, a model selecting section 535, a region specifying section 530, and the like. The nail region determining section 53 determines (specifies) the final nail region Ta which is to be the print target from the finger image according to the nail region judging program stored in the storage section 51.

Figure 20:
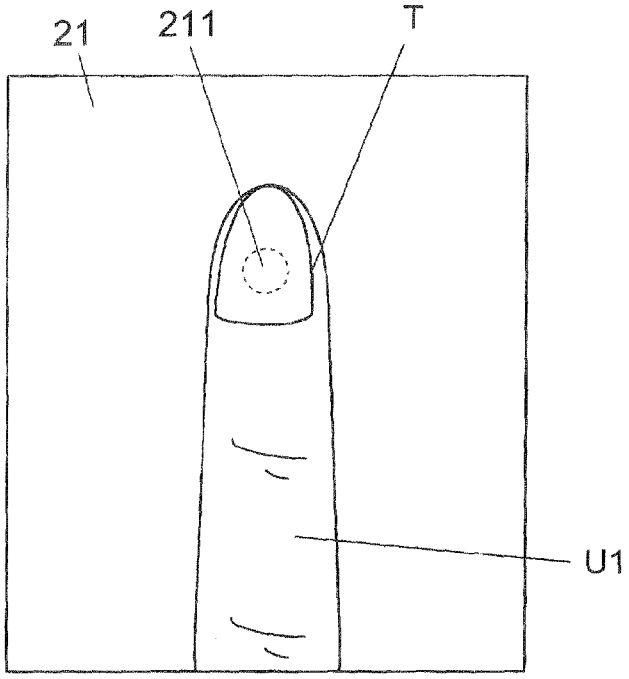
FIG. 20 is a diagram showing an example of a finger image of the print finger.

FIG. 20 is a diagram showing an example of a finger image of the print finger.

Figure 21:
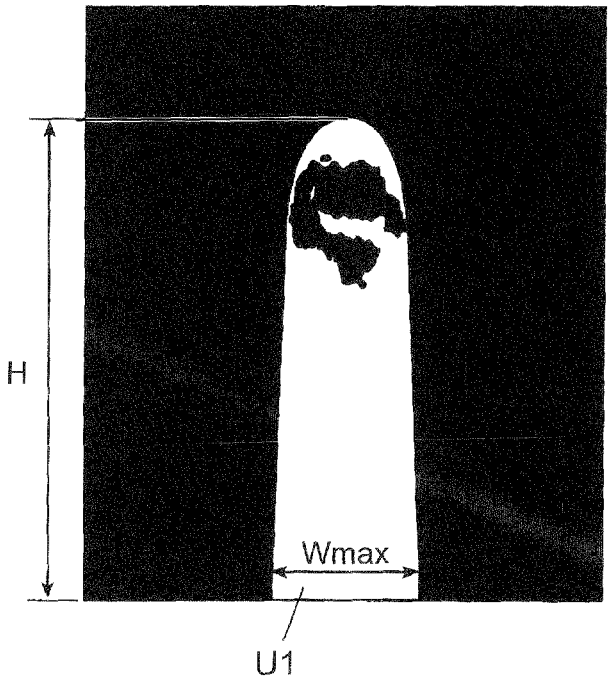
FIG. 21 is a diagram showing an example of a scanning image generated from the finger image shown in FIG. 20.

FIG. 21 is a diagram showing an example of a scanning image generated from the finger image shown in FIG. 20.

The scanning image generating section 531 generates a scanning image from the finger image (see FIG. 20) of the user obtained by the imaging section 30 by binarization in black and white using an intermediate value between the brightness of the print finger placing surface and the brightness of the finger image as the threshold value.

FIG. 21 shows an example in which the print finger placing surface which is the upper surface of the partition wall 21 is set to a color with a higher brightness than the color of the finger or the nail such as white or light gray, and the intermediate value between the brightness of the print finger placing surface and the brightness of the finger image is set as the threshold value. The scanning image is generated so that the finger region with a brightness lower than the threshold value (in other words, the nail region Ta which is the print target and the entire finger) is to be white and the region other than the above with a brightness higher than the threshold value (in other words, the print finger placing surface) is set to be black. Here, the black region of the finger region shown in FIG. 21 is a region which reflects the light from the illuminating light 33 with the upper surface of the finger or the nail and the brightness becomes higher than the surface of the finger and the nail nearby.

The image scanning section 532 sequentially scans the scanning image generated by the scanning image generating section 531 along the X-axis direction, in other words the width direction of the finger.

The image scanning section 532 sequentially scans the scanning image in the same order as when the reference point Pd of the nail region extracting model M is determined.

In the present embodiment, as described above, when the control device 50 determines the reference point Pd of the nail region extracting model M, the control device 50 sequentially scans from the top line of the image one line at a time along the X-axis direction from left to right. Therefore, similarly, the image scanning section 532 sequentially scans from the top line of the scanning image one line at a time along the X-axis direction, in other words, the width direction of the finger from left to right (see FIG. 22).

The black/white judging section 533 sequentially judges whether the pixel of the scanning image being scanned by the image scanning section 532 is the white pixel or the black pixel, while the image scanning section 532 scans each pixel of the scanning image.

The finger dimension obtaining section 534 obtains the dimension in the width direction of the finger (finger width) from the finger image obtained by the imaging section 30.

According to the present embodiment, the finger dimension obtaining section 534 obtains the maximum value of the finger width (maximum finger width) of the print finger U1 of the user in the finger image as the dimension in the width direction of the finger (finger width).

In other words, in the present embodiment, the finger dimension obtaining section 534 when there are a plurality of continuous pixels judged to be white by the black/white judging section 533 in the same line (row), the number of continuous pixels judged to be white is counted and the continuous number in each line (row) is stored in the storage section 51, etc.

When there are a plurality of continuous pixels judged to be white by the black/white judging section 533 in the same line, and then there are one or a plurality of pixels judged to be black, and then there are continuous pixels judged to be white again, the finger dimension obtaining section 534 stores in the storage section 51 the maximum value of white pixels continuous in the line as the number of continuous white pixels.

A "0" is stored in the storage section 51 for the line judged to have no white pixels by the black/white judging section 533.

Then, after the judgment between black and white by the black/white judging section 533 ends for the pixels of all of the lines, the finger dimension obtaining section 534 sets the number of pixels judged to be white in the line including the most continuous pixels judged to be white by the black/white judging section 533 as the number of pixels showing the maximum finger width of the finger.

Then, according to the present embodiment, the finger dimension obtaining section 534 converts the number of pixels showing the maximum finger width (unit: pixels) to the actual dimension width (unit: mm) considering the imaging position (in other words, the distance between the camera 32 and the finger) of the imaging section 30, etc. Then, the finger dimension obtaining section 534 stores the maximum finger width after conversion (actual dimension width) Wmax in the storage section 51.

The above describes the scanning image generating section 531 generating the scanning image with the finger region as white and the other regions as black, however, the color is not limited to the above.

For example, the print finger placing surface which is the upper surface of the partition wall 21 can be set to a color with a lower brightness than the color of the finger or the nail such as black or dark gray. The intermediate value between the brightness of the print finger placing surface and the brightness of the finger image can be set as the threshold value, and the scanning image can be generated with the finger region as black and the other regions as white. In this case, the finger dimension obtaining section 534 counts the number of continuous pixels judged to be black by the black/white judging section 533 in the same line and stores the number in the storage section 51, etc. The number of pixels judged to be black in the line including the most number of continuous pixels judged to be black by the black/white judging section 533 is to be the number of pixels showing the maximum finger width of the finger.

The model selecting section 535 selects a nail region extracting model M from the plurality of nail region extracting models M1 to M5 stored in the model memory region 51*a* of the storage section 51 based on the dimension (maximum finger width (actual dimension width) of the finger of the present embodiment) of the finger obtained by the finger dimension obtaining section 534.

The model selecting section 535 refers to the threshold value stored in the model selecting region 51*b* of the storage section 51 and selects the most suitable nail region extracting model M as the nail region extracting model M applied to the print finger U1 of the user.

Specifically, for example, when the maximum finger width Wmax of the print finger U1 of the user obtained by the finger dimension obtaining section 534 is 20 mm or more, the model selecting section 535 selects the nail region extracting model M1 for fat people. When the maximum finger width Wmax of the print finger U1 of the user is 18 mm or more and less than 20 mm, the model selecting section 535 selects the nail region extracting model M2 for males. When the maximum finger width Wmax of the print finger U1 of the user is 15 mm or more and less than 18 mm, the model selecting section 535 selects the nail region extracting model M3 for females. When the maximum finger width Wmax of the print finger U1 of the user is 13 mm or more and less than 15 mm, the model selecting section 535 selects the nail region extracting model M4 for thin people. When the maximum finger width Wmax of the print finger U1 of the user is less than 13 mm, the model selecting section 535 selects the nail region extracting model M5 for children (6 years old or younger).

The region specifying section 530 fits the nail region extracting model M selected by the model selecting section 535 to the finger image obtained by the imaging section 30 to specify the nail region Ta which is to be the print target.

The region specifying section 530 includes a reference pixel setting section 536, an initial position setting section 537 and a region adjusting section 538.

The reference pixel setting section 536 sets the reference pixel Cd of the finger image which is to be the reference when the nail region extracting model M is fit in the finger image of the user.

When the black/white judging section 533 judges whether each pixel is black or white in the order that the image is scanned by the image scanning section 532, the reference pixel setting section 536 sets the first pixel judged to be white among the plurality of pixels as the reference pixel Cd.

Figure 22:
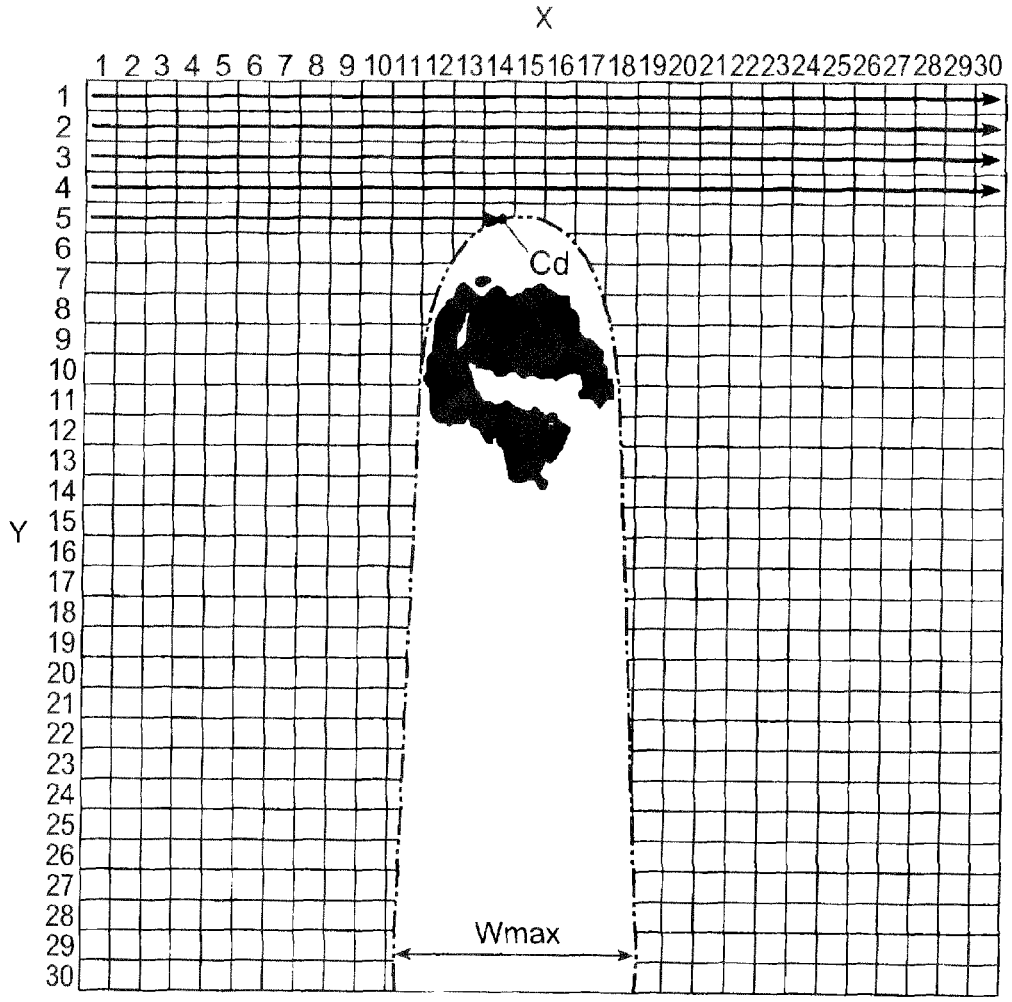
FIG. 22 is an explanatory diagram for explaining an example of a method to scan the scanning image to set the maximum finger width and the reference pixel.

FIG. 22 is an explanatory diagram for explaining an example of a method to scan the scanning image to set the maximum finger width and the reference pixel.

The scanning of the pixel of the scanning image is performed in order from the top of the scanning image (upper side in a direction of a height dimension H of the finger shown in FIG. 21) as shown in FIG. 22.

Here, the setting of the X-axis and the Y-axis and the position of the origin of the X-axis and the Y-axis in the scanning image are set similar to the X-axis and the Y-axis and the origin of the X-axis and the Y-axis set when the nail region extracting model is generated. With this, similar to FIG. 16 described above, in FIG. 22 also, the finger image includes 30 pixels in the X direction, 30 pixels in the Y direction and 900 (=30×30) pixels in total. Also similar to FIG. 16, the X-axis is a direction along the width direction of the finger, the Y-axis is a direction orthogonal to the X-axis, and a direction along the length direction of the finger, and the origin of the X-axis and the Y-axis is set to the upper left corner of the finger image.

FIG. 22 schematically shows the scanning image shown in FIG. 21 and the alternate long and two short dashes line shows the outline of the finger region shown in white in the scanning image.

As shown in FIG. 22, the present embodiment shows an example where the fourteenth pixel of the fifth line is the first pixel judged to be a white pixel.

In FIG. 22, the reference pixel setting section 536 sets the pixel represented by the coordinate value x=14, y=5 as the reference pixel Cd.

Figure 23:
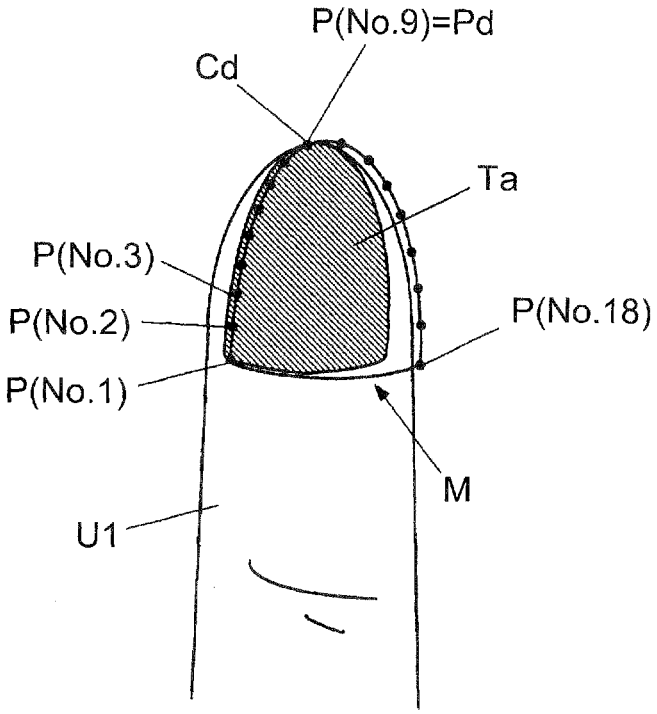
FIG. 23 is a diagram showing a state of positioning the nail region extracting model in an initial position on the finger image of the print finger.

FIG. 23 is a diagram showing a state of positioning the nail region extracting model in an initial position on the finger image of the print finger.

Figure 24:
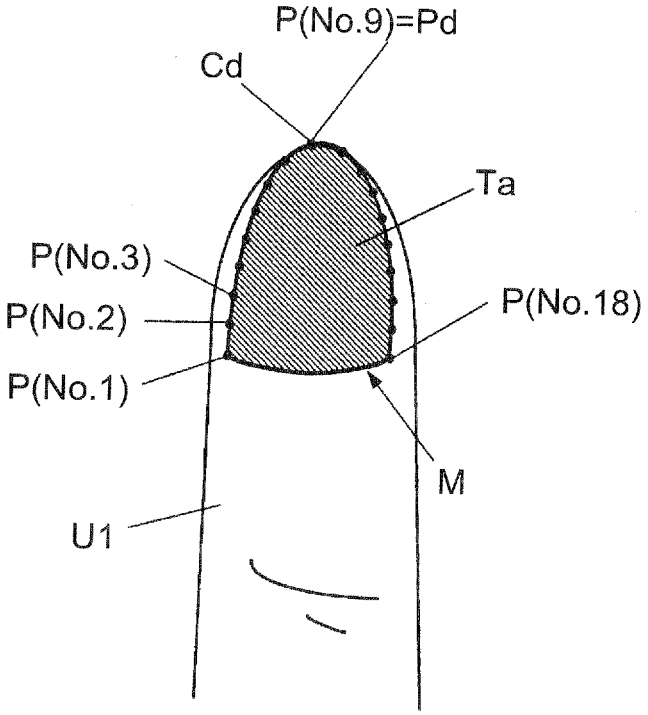
FIG. 24 is a diagram showing a state of fitting the nail region extracting model in the nail region of the finger image of the print finger.

FIG. 24 is a diagram showing a state of fitting the nail region extracting model in the nail region of the finger image of the print finger.

The initial position setting section 537 overlaps the reference point Pd of the nail region extracting model M on the pixel set as the reference pixel Cd by the reference pixel setting section 536 and sets the initial position of fitting the nail region extracting model M. With this, the initial position setting section 537 sets the nail region extracting model M on a position overlapping on the initial position of the finger image.

As described above, the nail region extracting model M is generated based on the finger image obtained similarly to when printing is performed on the nail of the user, and the user places the finger which is to be a sample on the print finger inserting section 20*a* of the nail print apparatus 1 and the finger is imaged to obtain the finger image. Therefore, the position and the direction of the nail region extracting model M (in other words, the region surrounded by the feature point P) and the nail region Ta of the print finger U1 of the user are substantially the same.

Therefore, the reference pixel Cd is set, and by overlapping the reference pixel Cd with the reference point Pd of the nail region extracting model M, the position of the feature point P other than the reference point Pd of the nail region extracting model M can be specified by the relation of the position from the reference point Pd.

With this, the points corresponding to the feature points P of the nail region extracting model M are provided on the finger image of the print finger U1 of the user and the points are connected to set the initial position for fitting the nail region extracting model M (see FIG. 23).

The region adjusting section 538 adjusts the range and the shape of the nail region extracting model M provided by the initial position setting section 537 to match the nail region Ta of the finger image.

The region adjusting section 538 applies a detecting algorithm using an AAM (Active Appearance Model) and updates the coordinate value of the nail region extracting model M to match the range and the shape of the nail region extracting model M to the nail region Ta of the finger image of the user. The region adjusting section 538 adjusts and updates the coordinate value of the nail region extracting model M and the final nail region Ta which is to be the print target is specified (see FIG. 24).

Next, the printing control method of the nail print apparatus 1 of the present embodiment is described.

Figure 17:
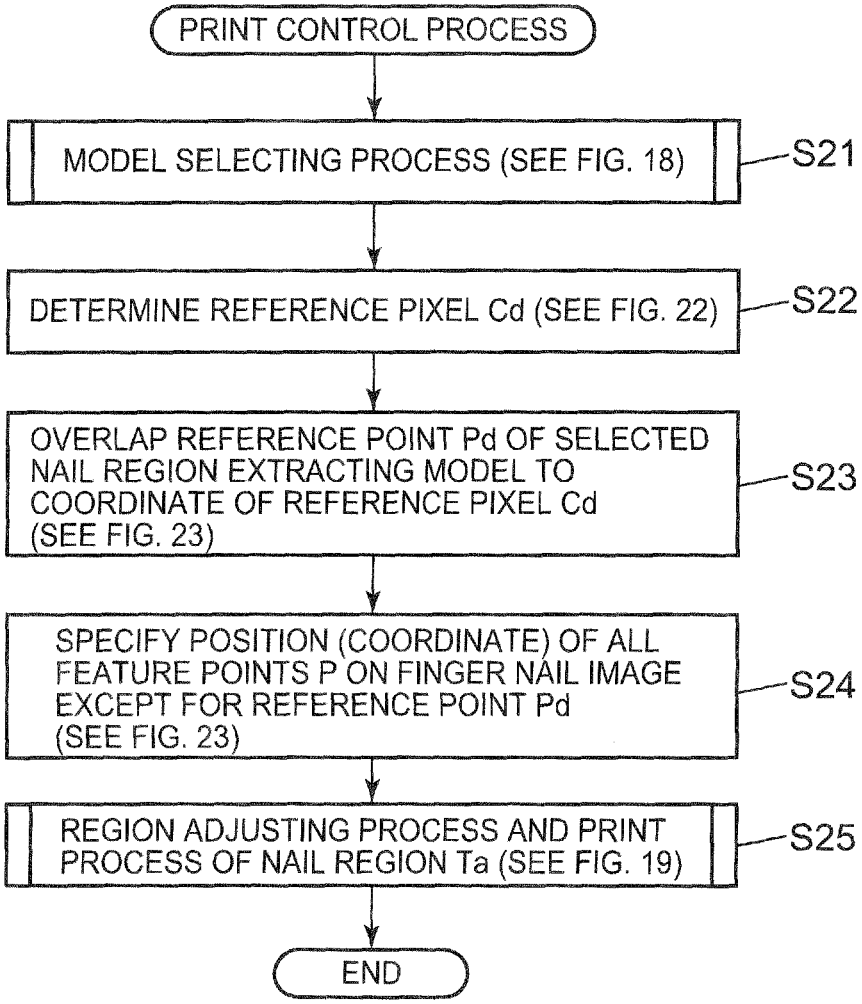
FIG. 17 is a flowchart showing a print control process of the present embodiment.

FIG. 17 is a flowchart showing a print control process of the present embodiment.

Figure 18:
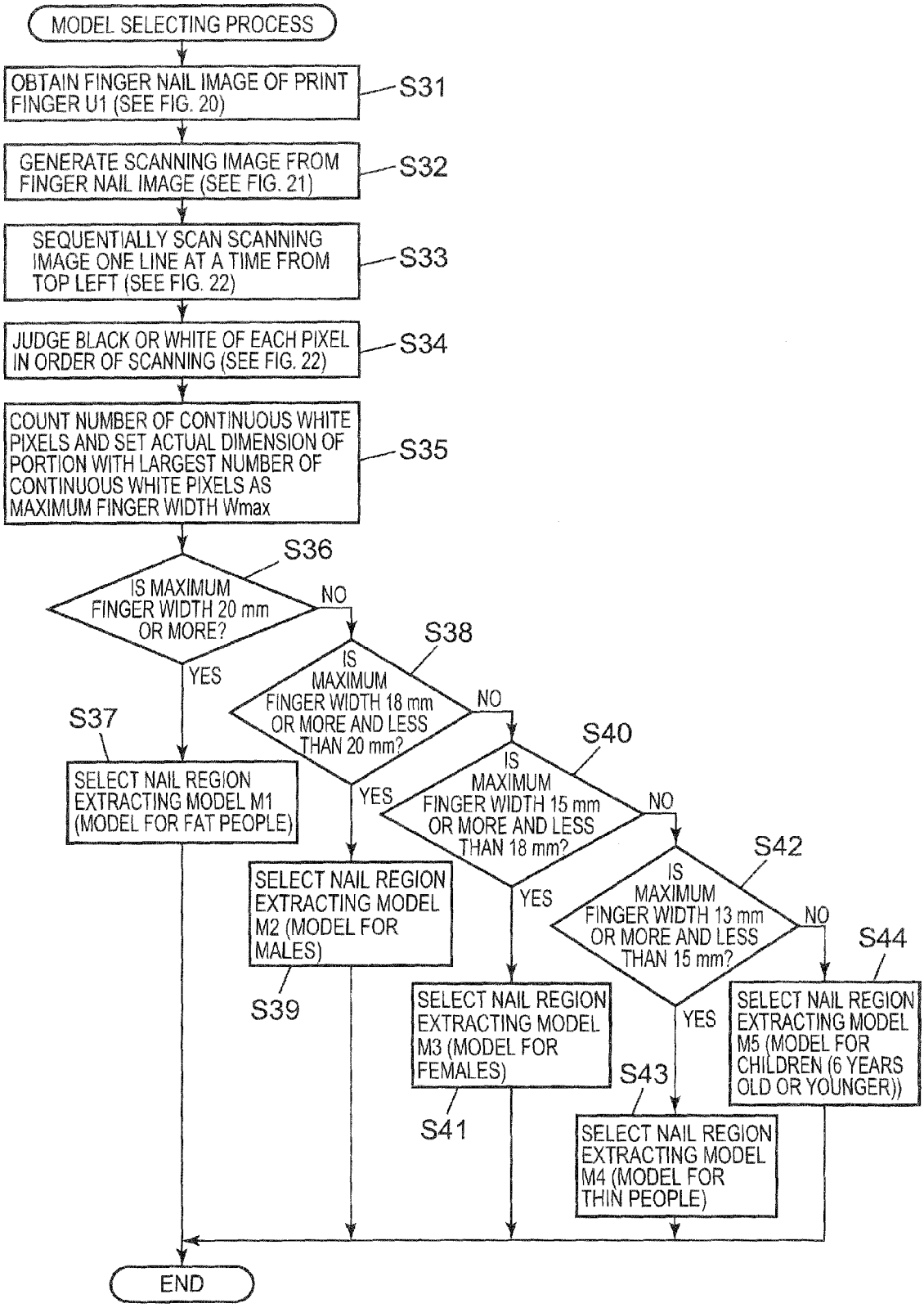
FIG. 18 is a flowchart showing a model selecting process in a print control process of the present embodiment.

FIG. 18 is a flowchart showing a model selecting process in a print control process of the present embodiment.

Figure 19:
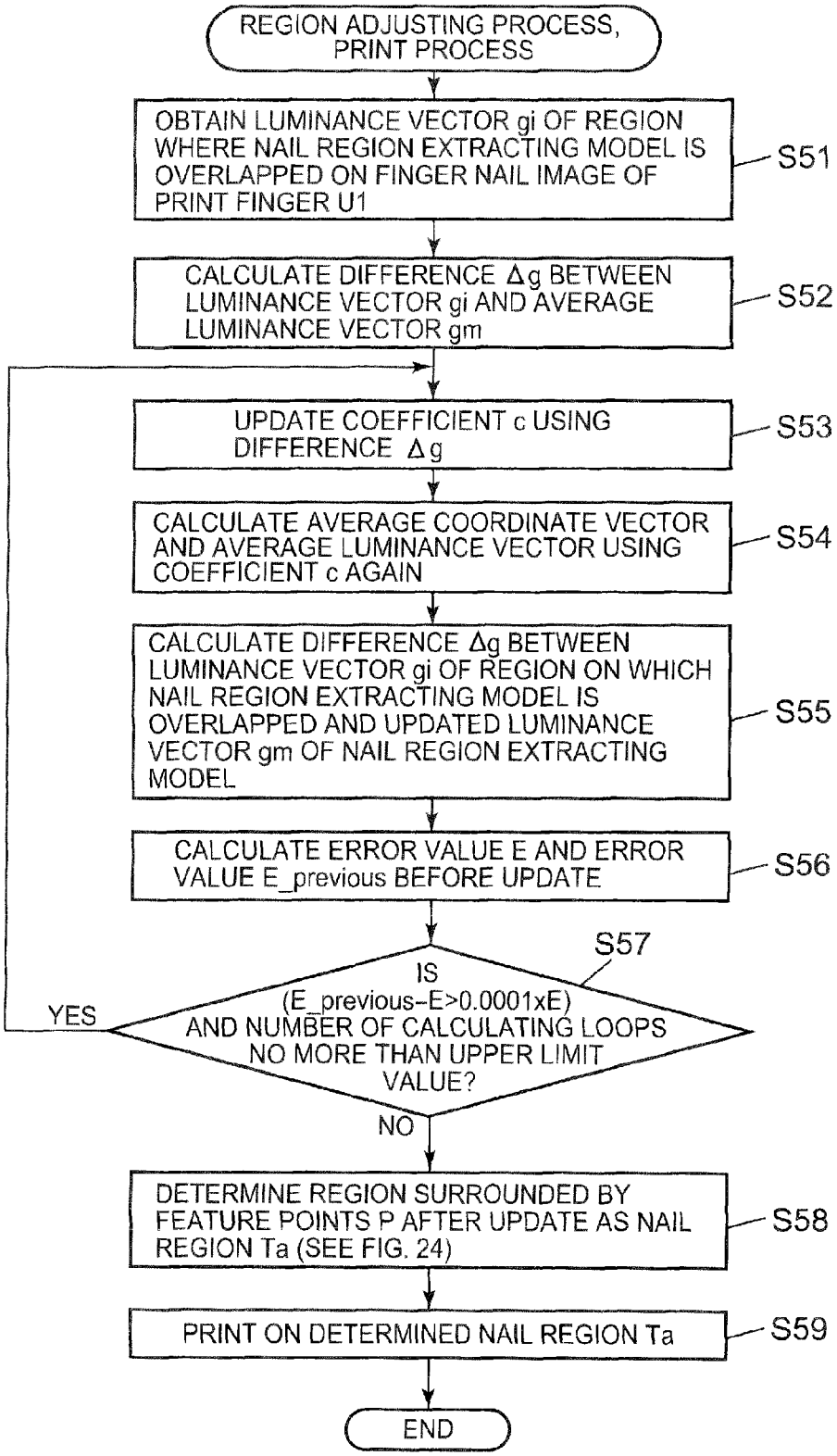
FIG. 19 is a flowchart showing a region adjusting process and a print process among the print control process of the present embodiment.

FIG. 19 is a flowchart showing a region adjusting process and a print process among the print control process of the present embodiment.

When printing is performed with the nail print apparatus 1, the user first turns the power switch on to start the control device 50 and selects the nail image pattern (design) desired to be printed on the print finger U1.

The selected nail image pattern is displayed on the display section 13 as the design confirming thumbnail image. When the user is satisfied with the design, the user confirms the nail image pattern with a confirming button which is not shown.

Next, the user inserts the print finger U1 in the print finger inserting section 20*a* to position the print finger on the positioning marker 211, inserts the non-print finger U2 in the non-print finger inserting section 20*b* to fix the print finger U1 and operates the print switch.

For example, when printing is performed on the nail region Ta of the index finger, the middle finger, the ring finger, and the little finger of the left hand, as shown in FIG. 3, the index finger, the middle finger, the ring finger, and the little finger are aligned to be flat and inserted in the print finger inserting section 20*a* and the thumb is inserted in the non-print finger inserting section 20*b*.

Then, the holding section 20*c* is held between the index finger, the middle finger, the ring finger, and the little finger inserted in the print finger inserting section 20*a* and the thumb inserted in the non-print finger inserting section 20*b*. With this, the index finger, the middle finger, the ring finger, and the little finger which are the print fingers U1 are fixed.

Then, as shown in FIG. 17, the control device 50 performs the model selecting process to select the nail region extracting model M which is to be applied to the user (see S21, FIG. 18).

First, as shown in FIG. 18, when the instruction to print is input from the print switch of the display section 13, the control device 50 controls the imaging section 30 to image the entire print finger U1.

With this, the finger image of the print finger U1 is obtained (see step S31, FIG. 20).

The data of the obtained finger image is stored in the RAM, etc. of the storage section 51.

Then, the scanning image generating section 531 of the nail region determining section 53 generates a scanning image in which the finger region (in other words, the nail region Ta which is the print target and the entire finger) of the finger image obtained by the imaging section 30 is white and the region other than the above is black (see step S32, FIG. 21).

The image scanning section 532 sequentially scans the scanning image generated by the scanning image generating section 531 from the top line one line at a time from the left to the right (see step S33, FIG. 22).

Then, the black/white judging section 533 judges whether each pixel of the scanning image is black or white in the order scanned by the image scanning section 532 (step S34).

The finger dimension obtaining section 534 counts the number of continuous pixels judged to be white in each line (row) in the direction of the height dimension H of the finger (FIG. 21) when a plurality of continuous pixels are judged to be white by the black/white judging section 533.

Then, after the judgment between black and white by the black/white judging section 533 ends for the pixels of all of the lines, the number of pixels judged to be white in the line with the most continuous pixels judged to be white by the black/white judging section 533 is to be the number of pixels showing the maximum finger width of the finger.

Then, the finger dimension obtaining section 534 converts the number of pixels (unit: pixel) showing the maximum finger width to the actual dimension width (unit: mm). Then, the finger dimension obtaining section 534 stores the value after conversion as the maximum finger width Wmax in the storage section 51 (step S35).

Next, the model selecting section 535 judges whether or not the maximum finger width Wmax of the print finger U1 of the user obtained by the finger dimension obtaining section 534 is 20 mm or more (step S36). Then, when the model selecting section 535 judges that the maximum finger width Wmax of the print finger U1 of the user is 20 mm or more (step S36; YES), the model selecting section 535 selects the nail region extracting model M1 for fat people as the nail region extracting model M to extract the nail region of the user (step S37).

When the model selecting section 535 judges that the maximum finger width Wmax of the print finger U1 of the user is not 20 mm or more (step S36; NO), the model selecting section 535 judges whether or not the maximum finger width Wmax of the print finger U1 of the user is 18 mm or more and less than 20 mm (step S38). Then, when the model selecting section 535 judges that the maximum finger width Wmax of the print finger U1 of the user is 18 mm or more and less than 20 mm (step S38; YES), the model selecting section 535 selects the nail region extracting model M2 for males (step S39).

When the model selecting section 535 judges that the maximum finger width Wmax of the print finger U1 of the user is not 18 mm or more and less than 20 mm (step S38; NO), the model selecting section 535 judges whether or not the maximum finger width Wmax of the print finger U1 of the user is 15 mm or more and less than 18 mm (step S40). Then, when the model selecting section 535 judges that the maximum finger width Wmax of the print finger U1 of the user is 15 mm or more and less than 18 mm (step S40; YES), the nail region extracting model M3 for females is selected (step S41).

When the model selecting section 535 judges that the maximum finger width Wmax of the print finger U1 of the user is not 15 mm or more and less than 18 mm (step S40; NO), the model selecting section 535 judges whether or not the maximum finger width Wmax of the print finger U1 of the user is 13 mm or more and less than 15 mm (step S42). Then, when the model selecting section 535 judges that the maximum finger width Wmax of the print finger U1 of the user is 13 mm or more and less than 15 mm (step S42; YES), the model selecting section 535 selects the nail region extracting model M4 for thin people (step S43).

When the model selecting section 535 judges that the maximum finger width Wmax of the print finger U1 of the user is 13 mm or more and less than 15 mm (step S42; NO), in other words, when the maximum finger width Wmax of the print finger U1 of the user is less than 13 mm, the model selecting section 535 selects the nail region extracting model M5 for children (6 years old or younger) as the nail region extracting model M to extract the nail region of the user (step S44).

Returning to FIG. 17, the reference pixel setting section 536 of the region specifying section 530 sets the pixel first judged to be the white pixel by the black/white judging section 533 in the scanning image generated from the finger image of the user as the reference pixel Cd (step S22).

In the present embodiment, the fourteenth pixel of the fifth line is set to the reference pixel Cd (see FIG. 22).

Next, the initial position setting section 537 overlaps the reference point Pd of the nail region extracting model M selected in the model selecting process (see FIG. 18) on the coordinate of the reference pixel Cd (in the present embodiment, coordinate values: x=14, y=5) of the finger image set by the reference pixel setting section 536 (step S23). The initial position setting section 537 specifies the position (coordinate) on the finger image of the feature point P other than the reference point Pd of the nail region extracting model M by the relation of the position from the reference point Pd (step S24). With this, the initial position for fitting the nail region extracting model M is set (see FIG. 23).

When the initial position of fitting the nail region extracting model M is set, the region adjusting section 538 adjusts the range and the shape of the nail region extracting model M positioned by the initial position setting section 537 to match the nail region Ta of the finger image and performs the region adjusting process to specify the final nail region Ta which is the print target region. Then, the print process is performed on the specified nail region Ta (see step S25, FIG. 24).

For example, according to the present embodiment, as shown in FIG. 23, No. 1 to No. 8 of the feature points P of the nail region extracting model M are slightly to the right side than the actual outline of the nail region Ta of the print finger U1. No. 10 to No. 18 of the feature points P of the nail region extracting model M are largely to the right side than the actual outline of the nail region Ta of the print finger U1.

Therefore, in order to match the nail region extracting model M with the proper nail region Ta, the position of No. 1 to No. 8 of the feature points P need to be modified slightly to the left and the position of No. 10 to No. 18 of the feature points P need to be modified largely to the left.

Specifically, the region adjusting process and the print process shown in FIG. 19 is performed.

In other words, the region adjusting section 538 obtains the luminance value of the region of the finger image on which the nail region extracting model M is overlapped as a vector (which is to be "luminance vector gi") (step S51).

Then, a difference Δg between the luminance vector gi and the eigenvector (which is to be "average luminance vector gm") of the averaged luminance value of the region surrounded by the feature points P of the nail region extracting model M calculated in the process of generating the nail region extracting model M and stored in the storage section 51 is calculated (step S52).

Next, the region adjusting section 538 updates the coefficient c using the difference Δg (step S53, the updated coefficient c is to be "updated value new_c").

In order to obtain the updated value new_c, the region adjusting section 538 obtains Δc using Δg. Δc can be obtained by the formula Δc=Δg×A. Here, A is a parameter already calculated in the process of generating the nail region extracting model M.

Further, Δc is used to obtain the updated value new_c. The updated value new_c can be obtained by new_c=c+Δc Then, the region adjusting section 538 considers the updated value new_c to be the coefficient c and calculates again the vector (which is to be "average coordinate vector sm") of the averaged coordinate value of the feature points P of the nail region extracting model M and the average luminance vector gm (step S54).

The updated value of the coordinate value s of the feature points P of the nail region extracting model M can be obtained by the formula s+Ps×Ws×Qs×c. Regarding the formula, Ps is the eigenvector of the coordinate value s, Ws is the diagonal matrix which normalizes the difference of units between the coordinate vector and the luminance vector and Qs is the eigenvector of the coordinate value and the luminance value. Here, other than the coefficient c, the values are already calculated in the process of generating the nail region extracting model M. Therefore, the coordinate value can be updated by updating only the value of the coefficient c.

The region adjusting section 538 obtains the luminance vector gi of the region of the finger image on which the nail region extracting model M is overlapped, and calculates the difference Δg between the luminance vector gi and the average luminance vector gm of the nail region extracting model M in which the value of the coefficient c is updated is calculated (step S55).

Then, the region adjusting section 538 sets the error e of the nail region extracting model M as error e=||Δg||, sets the error value E by square (e×e) of the error e, and calculates similarly using the Δg before update of the coefficient c to obtain the error value before update E_previous (step S56).

The region adjusting section 538 judges whether (E_previous−E>0.0001×E) and the number of calculating loops repeating the above calculating process is the upper limit value (for example, thirty times) or less (step S57).

Then, when the region adjusting section 538 judges (E_previous−E>0.0001×E) and the number of calculating loops repeating the above calculating process is the upper limit (for example, thirty times) or less (step S57; YES), the process of step S13 to step S17 is repeated.

The value "0.0001" in the formula is a coefficient for a convergence test and can be set freely. The upper limit value of the number of calculating loops is also not limited and can be set freely.

When the region adjusting section 538 judges that it is not (E_previous−E>0.0001×E) or the number of times of calculated loops exceeds the upper limit (for example, thirty times) (step S57; NO), the region adjusting section 538 considers the modification (update of the nail region extracting model M) of the error between the nail region extracting model M and the finger image is convergent, ends the region adjusting processing and specifies the region surrounded by the feature points P of the nail region extracting model M after update which is newest at this point of time as the nail region Ta which is the print target (see step S58, FIG. 24).

When the nail region Ta which is the print target is specified, the main body control section 52 controls the printing section 40 to perform printing on the nail region Ta of the print finger U1 of the user (step S59).

As described above, the present embodiment is a nail print apparatus 1 including an imaging section 30 shown in FIG. 6 which images a placed finger to obtain a finger image and a storage section 51 shown in FIG. 6 which stores data. The nail print apparatus 1 performs the following operation.

In other words, a plurality of feature points P shown in FIG. 16, etc. are input with a predetermined interval according to a touch operation along the outline of the nail region in the finger image obtained by the imaging section 30. Then, the control device 50 shown in FIG. 6 which is the storage control section stores in the model memory region 51*a* of the storage section 51 shown in FIG. 6 the coordinate positions of the plurality of input feature points P corresponded with the number as the nail region extracting model M shown in FIG. 13, etc.

After the control device 50 controls the storage section 51 to store the nail region extracting model M shown in FIG. 13, etc. in the model memory region 51*a* of the storage section 51, the image scanning section 532 shown in FIG. 6 sequentially scans the finger image newly obtained by the imaging section 30 from a predetermined direction.

The first coordinate position (in the present embodiment, the coordinate position of the reference pixel Cd) on the finger image is a position of the pixel judged by scanning with the image scanning section 532 to be the first pixel (in the present embodiment, the white pixel in the black and white scanning image) representing the finger region. The second coordinate position (in the present embodiment, the coordinate position of No. 9 of the feature point P) corresponding to the first coordinate position is extracted from the coordinate position of the plurality of feature points P of the nail region extracting model M stored in the model memory region 51*a* of the storage section 51.

The extracted second coordinate position (in the present embodiment, the coordinate position of No. 9 of the feature point P) is overlapped on the first coordinate position (in other words, coordinate position of the reference pixel Cd) as the reference point Pd of fitting the nail region extracting model M (S23 shown in FIG. 17).

The overlapped first coordinate position (in other words, coordinate position of the reference pixel Cd) and the second coordinate position (in other words, the coordinate position of No. 9 of the feature point P) are used as a reference and the other plurality of feature points P (No. 1 to No. 8 and No. 10 to No. 18) of the nail region extracting model M are matched so that coordinate positions (each x, y coordinate value of No. 1 to No. 8 of the feature points P and No. 10 to No. 18 of the feature points P) of the plurality of feature points P corresponded with the number (1 to 18) stored in the storage section 51 are positioned in the corresponding coordinate position on the finger image (see S51 to S58 of FIG. 19; FIG. 24).

The control device 50 shown in FIG. 6 which is the print control section controls the printing section 40 to print on the nail region Ta as shown in FIG. 24, etc. specified based on the plurality of matched coordinate positions (see S59 shown in FIG. 19; FIG. 24).

The process of generating the learning model file and the nail region extracting model M described in the present embodiment is one example, and the process can be suitably modified, for example, switching the order of the steps.

As described above, according to the nail print apparatus 1 of the present embodiment, a plurality of nail region extracting models M including outlines different from each other are stored in the storage section 51. The finger dimension obtaining section 534 obtains the dimension (in the present embodiment, maximum finger width Wmax) of the print finger U1 from the finger image of the user. Based on the obtained dimension (maximum finger width Wmax) of the finger, the model selecting section 535 selects a nail region extracting model M from the plurality of nail region extracting models M.

Therefore, the user does not have to input his sex, physique, etc. and by simply setting the finger in the nail print apparatus 1, the nail region extracting model M suitable for specifying the nail region of the user is selected automatically.

Then, by fitting the selected nail region extracting model M in the finger image, the nail region Ta which is to be the print target is specified. Therefore, the nail region Ta with a different position and size according to each individual can be specified easily, rapidly and highly accurately and printing can be accurately performed on the specified nail region Ta.

The dimensions of the finger which are the standards for selecting the nail region extracting model M are the width dimension of the finger and the length dimension of the finger. Therefore, the dimension of the finger can be easily obtained by a relatively simple image process of analyzing the scanning image where the finger image is converted to a binary of black and white. Therefore, the standard for selecting the nail region extracting model M can be obtained rapidly and the processing speed can be enhanced.

In the present embodiment, the nail region extracting model M, the learning model file, the number and the coordinate information of the reference point Pd, and the like are stored in the model memory region 51*a* of the storage section 51. Moreover, the reference pixel setting section 536 sets the reference pixel Cd of the finger image which is to be the standard for fitting the nail region extracting model M, the reference point Pd of the nail region extracting model M is overlapped on the coordinate of the reference pixel Cd and the initial position of fitting the nail region extracting model M is set.

Therefore, for example, when the nail region Ta is detected and specified using a detecting algorithm using the AAM, the model can be positioned in a suitable initial position easily and rapidly. Therefore, it is possible to highly accurately detect the nail region Ta which is greatly different according to each individual and which is difficult to discriminate from the entire finger.

When the reference pixel setting section 536 sets the reference pixel Cd, first, the finger image is binarized to black and white to clarify the finger region. Whether each pixel of the binarized scanning image is black or white is judged in the order of scanning and the first pixel judged to be the white pixel is set as the reference pixel Cd.

Therefore, the reference pixel Cd can be set unambiguously and the processing speed can be enhanced by a relatively simple image process.

The present embodiment describes an example where the maximum finger width Wmax of the finger is stored in the model selecting data region 51*b* as data for selecting the nail region extracting model M suitable for the user among the nail region extracting models M (M1 to M5). However, the data for selecting the nail region extracting model M is not limited to the above.

For example, the dimension of the length from the fingertip of the print finger U1 of the user to the base of the finger or the second joint of the finger (for example, height dimension H of the finger shown in FIG. 21) can be stored as the threshold value. Alternatively, the area, etc. of the print finger U1 can be stored as the threshold value.

Moreover, two or more of the maximum finger width, length dimension or area of the print finger U1 can be stored as threshold value and the nail region extracting model M applied to the user can be selected from a combination of the above.

The present embodiment describes an example where the actual dimension (unit: mm) of the maximum finger width Wmax of the finger is stored in the model selecting data region 51*b* as the threshold value for selecting the nail region extracting model M. However, the threshold value is not limited to the actual dimension of the maximum finger width Wmax of the finger, and for example, the number (unit: pix) of white pixels that continue when the finger is imaged from a predetermined position can be stored as the threshold value.

In this case, for example, when the number of continuous white pixels is 110 pixels or more, the nail region extracting model M1 which is the model for fat people for both males and females is selected. When the number of continuous white pixels is 90 pixels or more and less than 110 pixels, the nail region extracting model M2 which is the model for males is selected. When the number of continuous white pixels is 70 pixels or more and less than 90 pixels, the nail region extracting model M3 which is the model for females is selected. When the number of continuous white pixels is 60 pixels or more and less than 70 pixels, the nail region extracting model M4 which is the model for thin people for both males and females is selected. When the number of continuous white pixels is 60 pixels or less, the nail region extracting model M5 which is the model for children younger than elementary school children is selected.

The present embodiment describes an example of selecting the nail region extracting model M based on only the threshold value stored in the model selecting data region 51*b*. However, the method of selecting the nail region extracting model M is not limited to the above.

For example, when personal information such as sex, age, etc. of the user is registered in the nail print apparatus 1, such information can be used or such information can be combined with the threshold value stored in the model selecting data region 51*b* to select the nail region extracting model M.

For example, when the learning model file and the nail region extracting model M is prepared according to type of finger, the user can input the type of finger on which printing is performed.

The control device 50 can analyze the features of the image obtained by the imaging section 30 and automatically judge the type of finger to select the learning model file and the nail region extracting model M to be applied.

The present embodiment describes an example of overlapping the nail region extracting model M selected in the model selecting process to the actual nail region of the user in the region adjusting process. However, for example, when it is judged in the region adjusting process that the difference between the nail region extracting model M selected in the model selecting process and the actual nail region of the user is no less than a predetermined amount, another nail region extracting model M can be sequentially applied and the nail region extracting model M with the least difference can be used in the region adjusting process.

Once the learning model file and the nail region extracting model M is selected for a user, the same learning model file and the nail region extracting model M can be selected for future printing on the same user until the setting is canceled.

In this case, there is no need to perform the model selecting process again when the same user uses the nail print apparatus 1 and the processing time can be shortened.

Once the region adjusting process of the nail region using the learning model file and the nail region extracting model M is performed and the nail region Ta of the user is specified, the specified nail region can be used as the print target for future printing on the same user until the setting is canceled.

In this case, there is no need to perform the model selecting process and the region adjusting process again when the same user uses the nail print apparatus 1 and the processing time can be shortened.

When the model selecting section 535 selects the nail region extracting model M, the selected result can be displayed on the display section 13, etc. and the user can confirm, change, etc. the result.

The reference point Pd can be determined in advance and stored in the model memory region 51*a* and when the reference pixel setting section 536 sets the first coordinate position (in the present embodiment, the coordinate position of the reference pixel Cd) of the pixel judged to be the first pixel (in the present embodiment, the white pixel of the black and white scanning image) showing the finger region on the finger image by the scanning with the image scanning section 532, the reference point Pd can be overlapped on the above.

The second coordinate position (in the present embodiment, the coordinate position of No. 9 of the feature point P) corresponding to the first coordinate position (in the present embodiment, the coordinate position of the reference pixel Cd) of the pixel judged to be the first pixel (in the present embodiment, the white pixel of the black and white scanning image) showing the finger region on the finger image by the scanning with the image scanning section 532 can be extracted from the coordinate position of the plurality of feature points P of the nail region extracting model M stored in the model memory region 51*a* of the storage section 51 and the extracted second coordinate position (in the present embodiment, the coordinate position of No. 9 of the feature point P) can be set as the reference point Pd for fitting the nail region extracting model M and overlapped on the first coordinate position (in other words, the coordinate position of reference pixel Cd).

The calculating process of the eigenvector in the process of generating the learning model file and the nail region extracting model M, the warping process, the unifying process of the coefficient for controlling the coordinate value and the luminescent value with one coefficient and the like are for enhancing the processing speed of the computer, etc. Therefore, the above are not required elements of the present invention.

The configuration of the nail region extracting model M is not limited to corresponding the number of the feature point P and the coordinate value of the feature point P. For example, the nail region extracting model M can include other information such as information of which feature point P is the reference point Pd, the relation of position between the coordinate value of the feature point P and the reference point Pd, and the like. When the information of the reference point Pd is included in the nail region extracting model M, the information of the reference point Pd does not need to be stored separately in the model memory region 51*a*.

The present embodiment describes an example of the nail print apparatus 1 where four fingers can be inserted in the apparatus at once and the printing can be successively performed on the inserted four fingers. However, the present invention can be applied to an apparatus where the finger is inserted in the apparatus one finger at a time and the printing is sequentially performed.

The image showing the result of fitting the nail region extracting model M on the finger image can be displayed on the display section 13, etc. and the user can finely adjust the position, etc. of the feature point P after the fitting.

In this case, the finely adjusted nail region extracting model M is stored in the model memory region 51*a* and the finely adjusted nail region extracting model M can be applied when the same user is selected in the future.

In the present embodiment, the control device 50 of the nail print apparatus 1 performs preparation of the learning model file, the generating process of the nail region extracting model such as generating the nail region extracting model M, setting of the reference point Pd and the like. However, performing the preparation of the learning model file, the generating process of the nail region extracting model such as generating the nail region extracting model M, setting of the reference point Pd and the like is not limited to the control device 50 of the nail print apparatus 1.

For example, the data of the finger image of a plurality of people obtained by the nail print apparatus 1 before factory shipment can be copied and taken with a memory card, the data can be input in a model generating computer, etc. (not shown) different from the nail print apparatus 1 connected to an input device, etc. such as a pen tablet which is not shown, and the generating process of the nail region extracting model, the setting of the reference point Pd and the like can be performed on the model generating computer.

In this case, the input of the feature point P is performed using the pen tablet. The input device is not limited to the pen tablet and input, etc. of the feature point P can be performed using a pointing device such as a mouse on a typical monitor screen.

In this case, the method of taking data of the finger image used as the sample image from the nail print apparatus 1 and inputting the data in the model generating computer, etc. is not limited to using the memory card. For example, the data can be copied to a USB memory, etc. or the nail print apparatus 1 can be directly connected with the model generating computer, etc. with a cable and the data can be input.

The apparatus to obtain the data of the finger image used as the sample image is not limited to the nail print apparatus 1.

A different apparatus which can image with conditions (for example, direction of finger, position, etc.) similar to when the finger is placed on the finger placing section of the nail print apparatus 1 can be used to image the finger of a plurality of people to obtain the finger image and the data of the finger image can be input in the control device 50 of the nail print apparatus 1, the model generating computer, or the like to be used as the sample image.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A nail print apparatus which prints on a nail comprising:

an imaging section which obtains a finger image by imaging a finger including a nail to be printed;

a finger dimension obtaining section which obtains a dimension of the finger from the finger image obtained by the imaging section;

a storage section which stores a plurality of nail region extracting models including outlines with shapes different from each other;

a model selecting section which selects one specific nail region extracting model from the plurality of nail region extracting models stored in the storage section based on the dimension of the finger obtained by the finger dimension obtaining section;

a region specifying section which specifies a nail region which is to be a print target of the finger by fitting the specific nail region extracting model selected by the model selecting section to a region of the nail in the finger image; and a printing section which includes a printing head to apply ink to the nail region specified by the region specifying section;

wherein the storage section further stores a threshold value of the dimension of the finger corresponding to the nail region extracting models; and wherein the model selecting section selects the specific nail region extracting model based on a comparison between the dimension of the finger obtained by the finger dimension obtaining section and the threshold value stored in the storage section.

2. The nail print apparatus according to claim 1, wherein, the plurality of nail region extracting models are provided for each type of finger; and the model selecting section selects the specific nail region extracting model corresponding to the type of finger from the plurality of nail region extracting models.

3. The nail print apparatus according to claim 1, wherein the model selecting section automatically selects the specific nail region extracting model based on the dimension of the finger without operation by a user.

4. The nail print apparatus according to claim 1, wherein the finger dimension obtaining section obtains a maximum value of a dimension in a width direction of the finger or a dimension in a length direction of the finger as the dimension of the finger.

5. The nail print apparatus according to claim 1, further comprising:

a finger placing section including a print finger placing surface where the finger is placed when the finger is imaged by the imaging section;

a scanning image generating section which generates a scanning image by means of binarizing the finger image obtained by the imaging section, setting a region of the finger to either one of black or white, and setting a region other than the region of the finger to the other of black or white;

an image scanning section which scans the scanning image generated by the scanning image generating section by sequentially scanning each of a plurality of lines which are provided in the scanning image along a scanning direction; and a black/white judging section which sequentially judges whether each pixel of the scanning image scanned by the image scanning section is a white pixel or a black pixel, wherein the print finger placing surface is set to a color with a brightness different from that of the finger.

6. The nail print apparatus according to claim 5, wherein, the scanning direction is a width direction of the finger; and the finger dimension obtaining section obtains a maximum value of a number of continuous pixels which have only one color of black or white judged by the black/white judging section in each of the plurality of lines of the scanning image as a number of pixels corresponding to the dimension of the finger.

7. The nail print apparatus according to claim 5, wherein, the storage section stores coordinate values of a plurality of feature points corresponded to each of the nail region extracting models in which the coordinate values are provided along the outline of the nail region extracting models and include a reference point as a reference used in fitting the finger image, and the region specifying section further includes:

a reference pixel setting section which sets a reference pixel of the finger image which is to be a reference for fitting the nail region extracting model to the finger image;

an initial position setting section which sets an initial position of the specific nail region extracting model which is a position where the reference point of the specific nail region extracting model is overlapped to the reference pixel set by the reference pixel setting section, provides the nail region extracting model in the initial position, and provides the nail region extracting model in a position so that at least a portion overlaps with the finger image; and a region adjusting section which adjusts the coordinate values of the feature points of the specific nail region extracting model provided in the initial position in a direction to match the region surrounded by the feature points with the nail region of the finger image and which sets a region surrounded by the feature points including the adjusted coordinate values to the nail region.

8. The nail print apparatus according to claim 7, wherein the reference pixel setting section sets a specific pixel first judged to be the one color of black or white by the black/white judging section among the plurality of pixels of the scanning image to the reference pixel according to the scanning of the scanning image by the image scanning section.

9. The nail print apparatus according to claim 7, wherein the region adjusting section:

calculates a first difference between a luminance vector of a first nail region model including coordinate values of the feature points updated to a first value and a luminance vector of a region where the first nail region model is overlapped on the finger image;

updates the coordinate values of the feature points to a second value different from the first value based on the value of the first difference and calculates a second difference between a luminance vector of the second nail region model in which the coordinate values of the feature points are updated to the second value and a luminance vector of a region where the second nail region model is overlapped on the finger image; and sets the second value of the feature points to the adjustment value when a percentage of change of the second difference with respect to the first difference is a value smaller than a predetermined amount.

10. A printing control method of a nail print apparatus which prints on a nail comprising the steps of:

obtaining a finger image by imaging a finger including a nail to be printed;

obtaining a dimension of the finger from the obtained finger image;

selecting one specific nail region extracting model from a plurality of nail region extracting models including outlines with shapes different from each other stored in a storage section based on the obtained dimension of the finger;

specifying a nail region which is to be a print target of the finger by fitting the selected specific nail region extracting model to a region of the nail in the finger image; and applying ink to the specified nail region with a printing head;

wherein the storage section further stores a threshold value of the dimension of the finger corresponding to the nail region extracting models; and wherein the step of selecting the specific nail region extracting model includes selecting the specific nail region extracting model based on a comparison between the obtained dimension of the finger and the threshold value stored in the storage section.

11. The printing control method of a nail print apparatus according to claim 10, wherein, the plurality of nail region extracting models are provided for each type of finger; and the step of selecting the specific nail region extracting model includes selecting the specific nail region extracting model corresponding to the type of finger from the plurality of nail region extracting models.

12. The printing control method of a nail print apparatus according to claim 10, wherein the step of selecting the specific nail region extracting model includes automatically selecting the specific nail region extracting model based on the dimension of the finger without operation by a user.

13. The printing control method of a nail print apparatus according to claim 10, wherein the step of obtaining the finger dimension includes obtaining a maximum value of a dimension in a width direction of the finger or a dimension in a length direction of the finger as the dimension of the finger.

14. The printing control method of a nail print apparatus according to claim 10, wherein, the step of obtaining the finger image includes obtaining the finger image by imaging the finger placed on a print finger placing surface set to a color with a brightness different from that of the finger and a portion of an upper surface of the print finger placing surface surrounding the finger;

the step of obtaining the finger dimension includes:

generating a scanning image by means of binarizing the obtained finger image, setting a region of the finger to either one of black or white, and setting a region other than the region of the finger to the other of black or white;

scanning the generated scanning image by sequentially scanning each of a plurality of lines which are provided in the scanning image along a scanning direction; and sequentially judging whether each pixel of the scanned scanning image is a white pixel or a black pixel, and obtaining a maximum value of a number of continuous pixels which have only one color of black or white in each of the plurality of lines of the scanning image as a number of pixels corresponding to the dimension of the finger.

15. The printing control method of a nail print apparatus according to claim 10, wherein, the storage section stores coordinate values of a plurality of feature points corresponded to each of the nail region extracting models in which the coordinate values are provided along the outline of the nail region extracting models and include a reference point as a reference used in fitting the finger image, the step of obtaining the finger image includes obtaining the finger image by imaging the finger placed on a print finger placing surface set to a color with a brightness different from that of the finger and a portion of an upper surface of the print finger placing surface surrounding the finger, and the step of specifying the nail region includes:

setting a reference pixel of the finger image which is to be a reference for fitting the nail region extracting model to the finger image;

setting an initial position of the specific nail region extracting model which is a position where the reference point of the specific nail region extracting model is overlapped to the reference pixel, providing the nail region extracting model in the initial position, and providing the nail region extracting model in a position so that at least a portion overlaps with the finger image; and adjusting the coordinate values of the feature points of the specific nail region extracting model provided in the initial position in a direction to match the region surrounded by the feature points with the nail region of the finger image and setting a region surrounded by the feature points including the adjusted coordinate values to the nail region.

16. The printing control method of a nail print apparatus according to claim 15, wherein, the step of setting the reference pixel includes:

generating a scanning image by means of binarizing the obtained finger image, setting a region of the finger to either one of black or white, and setting a region other than the region of the finger is set to the other of black or white;

scanning the generated scanning image by sequentially scanning each of a plurality of lines which are provided in the scanning image along a scanning direction; and sequentially judging whether each pixel of the scanned scanning image is a white pixel or a black pixel, and setting a specific pixel first judged to be the one color of black or white among the plurality of pixels of the scanning image to the reference pixel.

17. The printing control method of a nail print apparatus according to claim 15, wherein, the step of adjusting the coordinate value of the feature points of the specific nail region extracting model includes:

calculating a first difference between a luminance vector of a first nail region model including coordinate values of the feature points updated to a first value and a luminance vector of a region where the first nail region model is overlapped on the finger image;

updating the coordinate values of the feature points to a second value different from the first value based on the value of the first difference and calculating a second difference between a luminance vector of the second nail region model in which the coordinate values of the feature points are updated to the second value and a luminance vector of a region where the second nail region model is overlapped on the finger image; and setting the second value of the feature points to the adjustment value when a percentage of change of the second difference with respect to the first difference is a value smaller than a predetermined amount.

* * * * *